US010940346B2

(12) United States Patent
Phung et al.

(10) Patent No.: US 10,940,346 B2
(45) Date of Patent: Mar. 9, 2021

(54) FIRE EXTINGUISHING SYSTEM AND METHOD THEREFOR

(71) Applicant: The Boeing Company, Chicago, IL (US)

(72) Inventors: Connie Phung, Bellevue, WA (US); Rita J. Olander, Seattle, WA (US); John A. Weidler, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/985,141

(22) Filed: May 21, 2018

(65) Prior Publication Data

US 2019/0351269 A1 Nov. 21, 2019

(51) Int. Cl.

| | |
|---|---|
| ***A62C 31/03*** | (2006.01) |
| ***A62C 31/05*** | (2006.01) |
| ***A62C 3/08*** | (2006.01) |
| ***A62C 99/00*** | (2010.01) |

(52) U.S. Cl.

CPC ..... *A62C 31/03* (2013.01); *A62C 3/08* (2013.01); *A62C 31/05* (2013.01); *A62C 99/0018* (2013.01)

(58) Field of Classification Search

CPC ..... A62C 31/03; A62C 31/05; A62C 1/08; A62C 99/0018

USPC ..... 239/62

See application file for complete search history.

(56) References Cited

U.S. PATENT DOCUMENTS

| | | | | |
|---|---|---|---|---|
| 1,952,281 | A | 3/1934 | Ranque | |
| 2,907,174 | A | 10/1959 | Hendal | |
| 3,546,891 | A | 12/1970 | Fekete | |
| 5,495,893 | A | 3/1996 | Roberts et al. | |
| 5,597,044 | A | 1/1997 | Roberts et al. | |
| 5,918,679 | A * | 7/1999 | Cramer | B60K 15/03 169/45 |
| 7,153,446 | B2 * | 12/2006 | Grigg | A62D 1/00 252/3 |

(Continued)

FOREIGN PATENT DOCUMENTS

| | | |
|---|---|---|
| CN | 107036392 | 8/2017 |
| CN | 206709497 | 12/2017 |

(Continued)

OTHER PUBLICATIONS

Yunpeng Xue, The Working principle of a Ranque-Hilsch Vortex Tube, School of Mechanical Engineering, The university of Adelaide South Australia, 2012, all pages (Year: 2012).*

(Continued)

*Primary Examiner* — Joseph A Greenlund

(74) *Attorney, Agent, or Firm* — Perman & Green LLP

(57) ABSTRACT

A fire extinguishing system including a fluid storage container configured to store a fire extinguishing agent, and a fluid stream separating device coupled to the fluid storage container, where the fire extinguishing agent passes from the fluid storage container through the fluid stream separating device so that the fluid stream separating device raises a temperature of at least a portion of the fire extinguishing agent flowing through the fluid stream separating device above a boiling point of the fire extinguishing agent at ambient environmental conditions of a discharge location of the fluid stream separating device.

20 Claims, 11 Drawing Sheets

(56) References Cited

U.S. PATENT DOCUMENTS

| | | | | |
|---|---|---|---|---|
| 7,900,709 | B2 * | 3/2011 | Kotliar | A62C 3/0221 169/45 |
| 10,247,144 | B2 * | 4/2019 | Keppy | F02M 26/30 |
| 10,300,431 | B2 * | 5/2019 | Rheaume | B01D 53/30 |
| 10,640,227 | B2 * | 5/2020 | Smith | A62C 3/065 |
| 2006/0273223 | A1 * | 12/2006 | Haaland | A62C 3/065 244/129.2 |
| 2006/0283977 | A1 * | 12/2006 | Macdonald | A62C 99/0009 239/288 |
| 2009/0321090 | A1 * | 12/2009 | Bleil | A62C 99/00 169/46 |
| 2013/0240217 | A1 * | 9/2013 | Mitchell | A62D 1/0092 169/5 |
| 2013/0240218 | A1 * | 9/2013 | Mitchell | A62D 1/00 169/16 |
| 2014/0202719 | A1 * | 7/2014 | Senecal | A62C 13/68 169/46 |
| 2015/0041157 | A1 * | 2/2015 | Mitchell | A62D 1/0092 169/16 |
| 2015/0333347 | A1 * | 11/2015 | Brunaux | H01M 8/04776 429/446 |
| 2018/0099169 | A1 * | 4/2018 | Lucas | A62C 31/05 |
| 2018/0221695 | A1 * | 8/2018 | Shaw | A62C 37/04 |
| 2018/0272283 | A1 * | 9/2018 | Rheaume | A62D 1/0092 |
| 2018/0318624 | A1 * | 11/2018 | Richard | A62D 1/0085 |
| 2019/0174833 | A1 * | 6/2019 | Shuster | A24F 1/02 |
| 2019/0290948 | A1 * | 9/2019 | Mahrt | A62C 5/022 |
| 2019/0351269 | A1 * | 11/2019 | Phung | A62C 31/03 |

FOREIGN PATENT DOCUMENTS

| | | |
|---|---|---|
| JP | 2007028863 | 2/2007 |
| RU | 2126702 | 2/1999 |

OTHER PUBLICATIONS

Newman Tools Inc. Vortex Tubes for spot cooling, all pages, Mar. 2, 2017. (Year: 2017).*

R Liew et al. Droplet Behavior in a Ranguq-Hilsch vortex tube. J. Phys.: Conf. Ser. 318, 2011 (Year: 2011).*

Xue, "The Working Principle of a Ranque-Hilsch Vortex Tube"; http://digital.library.adelaide.edu.au/dspace/bitstream/2440/82139/8/02whole.pdf.

Vortex Tube www.exair.com referenced on Mar. 8, 2018 www.exair.com/index.php/products/vortex-tubes-and-spot-cooling-products/vortex-tubes/vt.html.

"Vortex Tube, Overview, History and Theory"; Wikipedia, https://en.wikipedia.org/wiki/Vortex_tube, Mar. 8, 2018.

Vortex Tube and Spot Cooling System www.exair.com referenced on Mar. 8, 2018, www.exair.com/index.php/products/vortex-tubes-and-spot-cooling-products.html.

European Search Report dated Dec. 9, 2019; EP Application No. 19173759.2.

* cited by examiner

FIRE EXTINGUISHING SYSTEM AND METHOD THEREFOR

BACKGROUND

1. Field

The exemplary embodiments generally relate to fire extinguishing systems and more particularly to fire extinguishing systems employing vortex tubes to increase cold environment performance of a fire extinguishing agent.

2. Brief Description of Related Developments

Generally, commercial airplane fire extinguishing systems use Halon 1301 as a fire extinguishing agent. At the present time, Halon 1301 is being phased out of all industry use for environmental reasons. Halon 1301 has a boiling temperature of about −71° F. (−57° C.). Alternative fire extinguishing agents are being explored as a replacement for Halon 1301; however, the alternative fire extinguishing agents may have a higher boiling temperature than Halon 1301. The higher boiling temperature of the alternative fire extinguishing agents may impact the performance of these fire extinguishing agents in cold temperature environments that have temperatures that are at or below the boiling temperature of the respective fire extinguishing agents.

SUMMARY

Accordingly, apparatuses and methods, intended to address at least one or more of the above-identified concerns, would find utility.

The following is a non-exhaustive list of examples, which may or may not be claimed, of the subject matter according to the present disclosure.

One example of the subject matter according to the present disclosure relates to a fire extinguishing system including a fluid storage container configured to store a fire extinguishing agent, and a fluid stream separating device coupled to the fluid storage container, where the fire extinguishing agent passes from the fluid storage container through the fluid stream separating device so that the fluid stream separating device raises a temperature of at least a portion of the fire extinguishing agent flowing through the fluid stream separating device above a boiling point of the fire extinguishing agent at ambient environmental conditions of a discharge location of the fluid stream separating device.

Another example of the subject matter according to the present disclosure relates to a fire extinguishing system for a vehicle having an engine, the fire extinguishing system including a fluid storage container configured to store a fire extinguishing agent; and a fluid stream separating device coupled to the fluid storage container, the fluid stream separating device being configured to mechanically separate the fire extinguishing agent flowing through the fluid stream separating device into a hot discharge component and a cold discharge component, where the hot discharge component has a temperature above a boiling point of the fire extinguishing agent at ambient environmental conditions of a discharge location of the fluid stream separating device.

Still another example of the subject matter according to the present disclosure relates to a method of using a fire extinguishing system, the method including storing a fire extinguishing agent in a fluid storage container; and mechanically separating, with a fluid stream separating device coupled to the fluid storage container, the fire extinguishing agent flowing through the fluid stream separating device into a hot discharge component and a cold discharge component, where the hot discharge component has a temperature above a boiling point of the fire extinguishing agent at ambient environmental conditions of a discharge location of the fluid stream separating device.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a schematic isometric illustration of an aircraft in accordance with aspects of the present disclosure;

FIG. 2A is a schematic diagram illustration of an exemplary fire extinguishing system in accordance with aspects of the present disclosure;

FIG. 2B is a schematic diagram illustration of an exemplary fire extinguishing system in accordance with aspects of the present disclosure;

FIG. 3A is a schematic isometric illustration of a portion of the aircraft (e.g., an engine) of FIG. 1 in accordance with aspects of the present disclosure;

FIG. 3B is an exemplary isometric cut-away illustration of a portion of the engine of FIG. 3A in accordance with aspects of the present disclosure;

FIG. 4A is a schematic illustration of a portion of the fire extinguishing system of either one of FIGS. 2A and 2B in accordance with aspects of the present disclosure;

FIGS. 4B and 4C are exemplary illustrations of fluid stream separating devices of the fire extinguishing system of either one of FIGS. 2A and 2B in accordance with aspects of the present disclosure;

FIG. 5 is an exemplary illustration of a fluid stream separating device of the fire extinguishing system of either one of FIGS. 2A and 2B in accordance with aspects of the present disclosure;

FIG. 6A is an exemplary illustration of a fluid stream separating device of the fire extinguishing system of either one of FIGS. 2A and 2B in accordance with aspects of the present disclosure;

FIG. 6B is an exemplary illustration of a fluid stream separating device of the fire extinguishing system of either one of FIGS. 2A and 2B in accordance with aspects of the present disclosure;

FIG. 6C is an exemplary illustration of a fluid stream separating device of the fire extinguishing system of either one of FIGS. 2A and 2B in accordance with aspects of the present disclosure;

Figure 7:
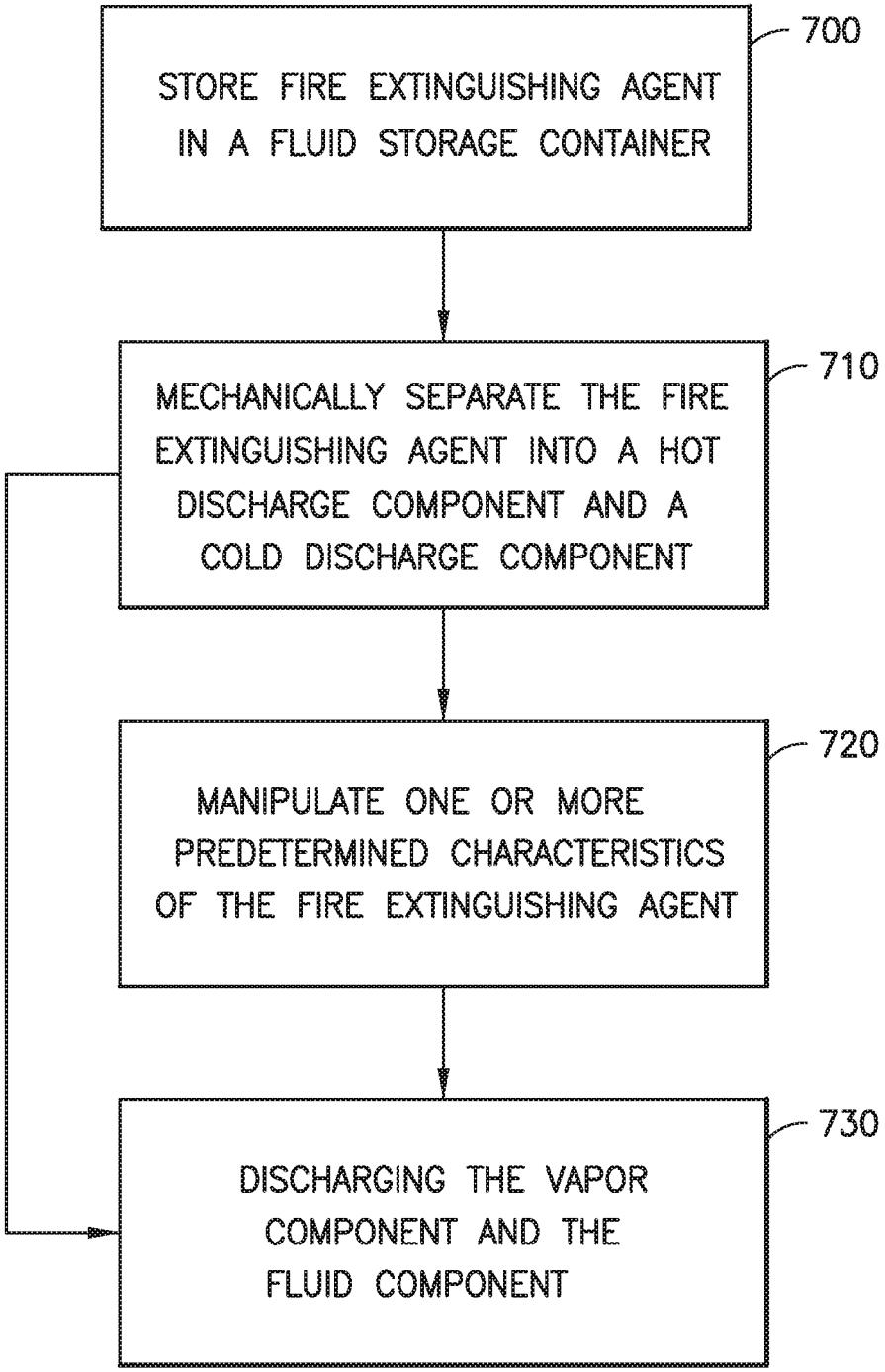
Figure 8:
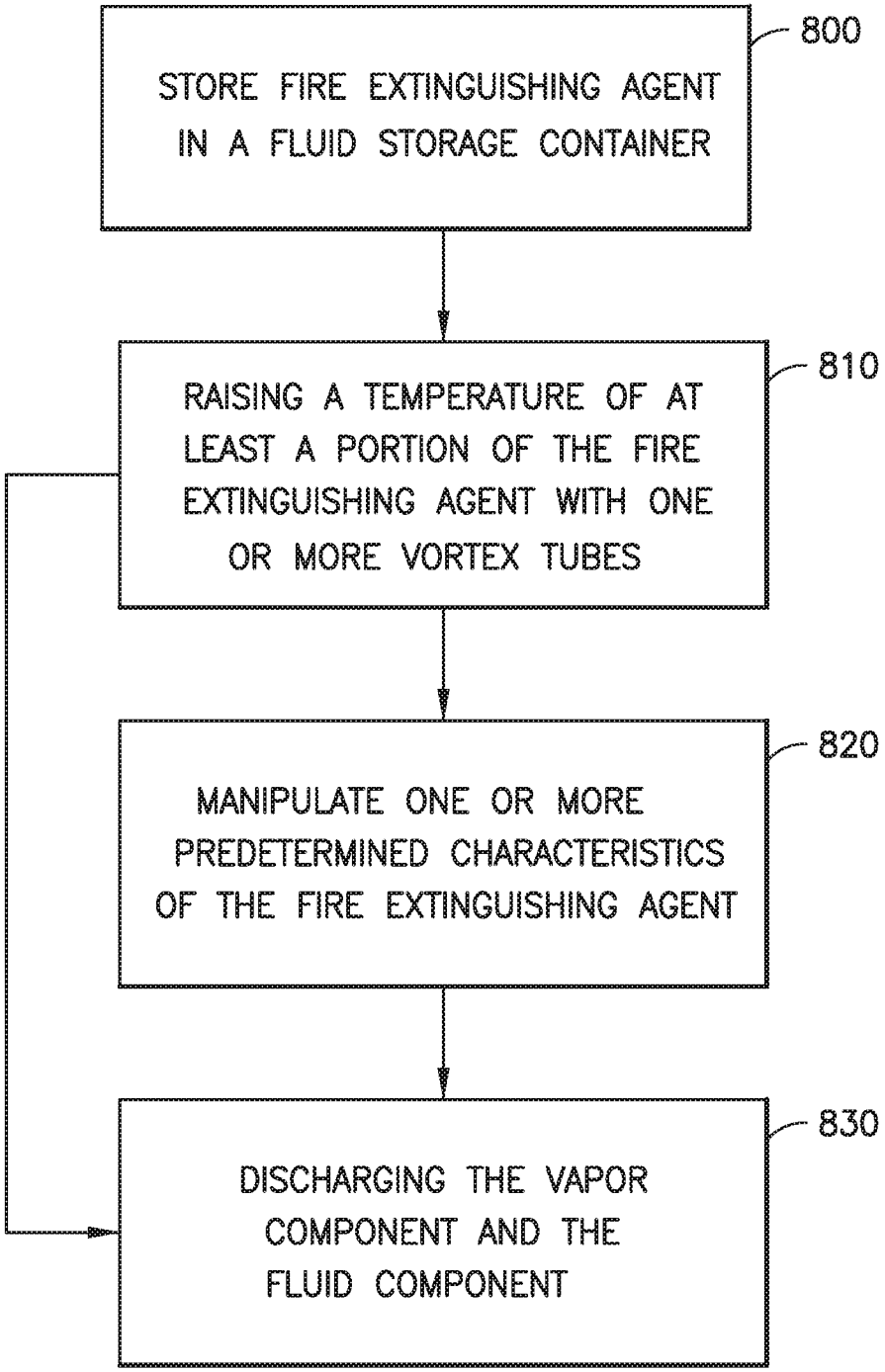
Figure 9B:
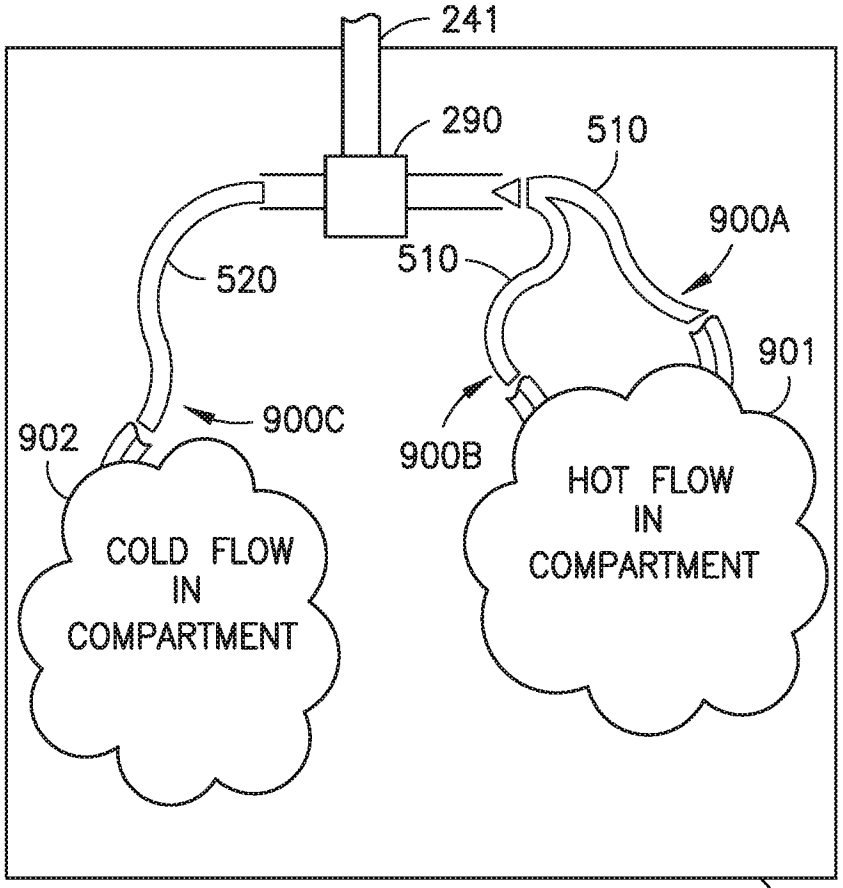
Figure 9A:
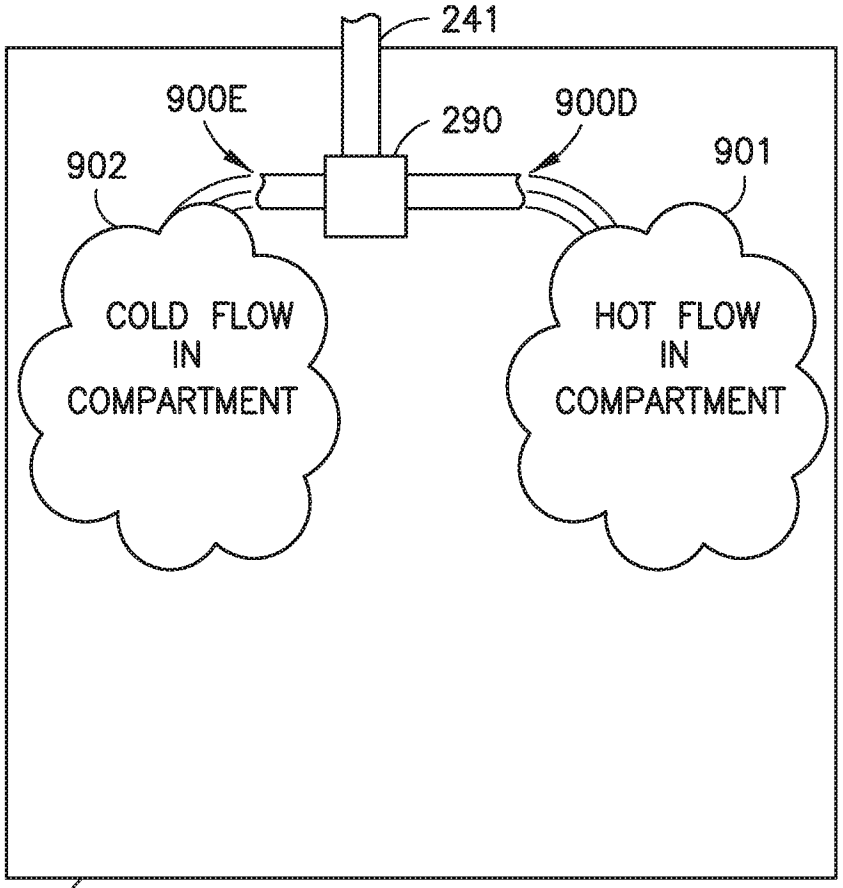

FIG. 7 is an exemplary flow diagram of a method in accordance with aspects of the present disclosure;

FIG. 8 is an exemplary flow diagram of a method in accordance with aspects of the present disclosure; and FIGS. 9A and 9B are schematic illustrations showing exemplary exit planes of a fire extinguishing system in accordance with aspects of the present disclosure.

DETAILED DESCRIPTION

Figure 1:
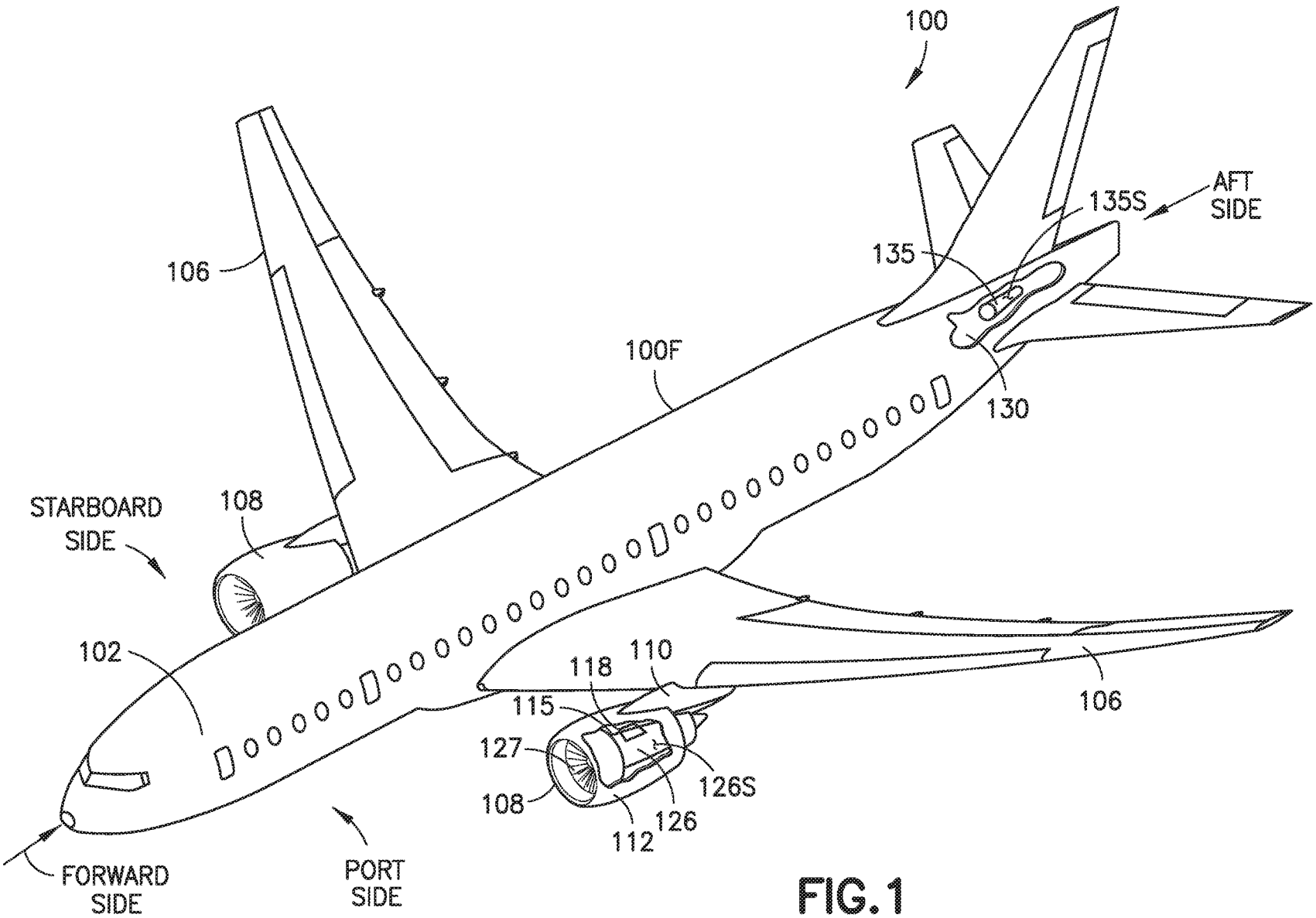
Figure 2A:
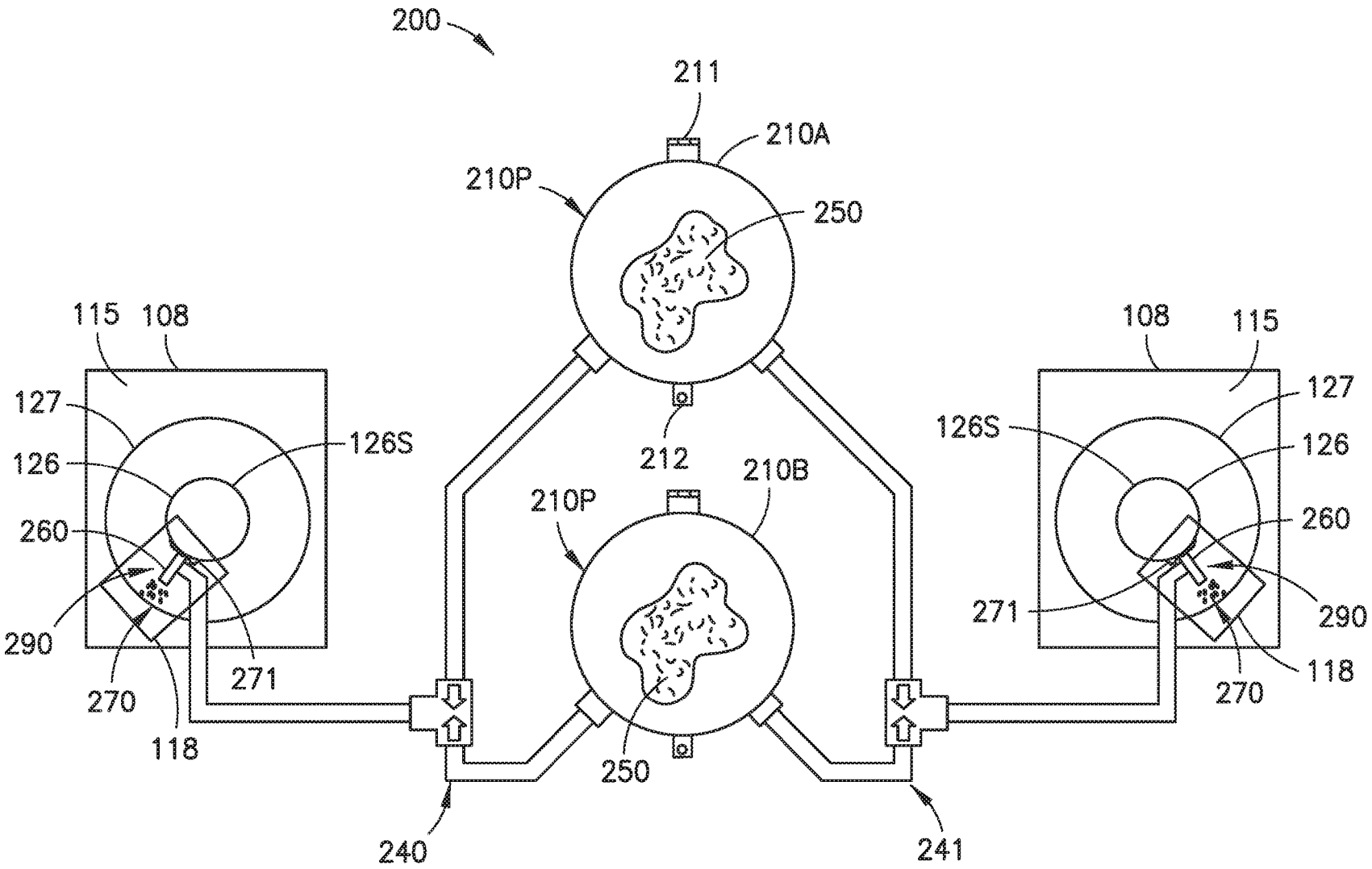
Figure 2B:
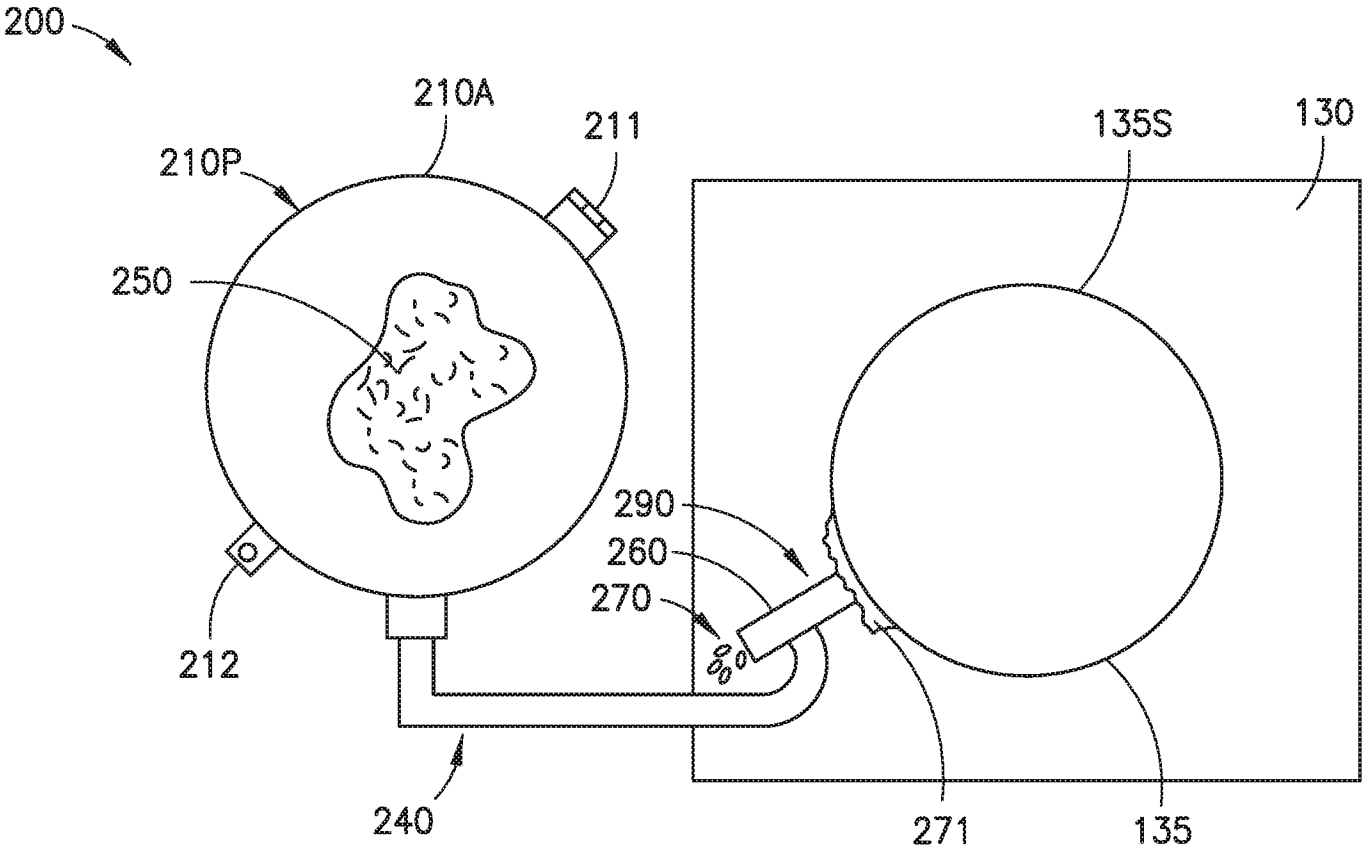

Referring to FIGS. 1, 2A and 2B, the aspects of the present disclosure may provide for a fire extinguishing system 200 for use in environments having ambient temperatures at or below a boiling point of a fire extinguishing agent 250 used therein. The aspects of the present disclosure may be integrated into new vehicles or retrofit into existing vehicles by installing the aspects of the present disclosure to existing fire extinguishing system manifolds. The fire extinguishing system 200 described herein may provide ambient condition operation, including cold environment operation, of the fire extinguishing system 200, where the cold environment operation includes temperatures near or below a boiling point of a fire extinguishing agent 250 used in the fire extinguishing system 200. As used herein, the term "boiling point" refers to the boiling point of the fire extinguishing agent 250 when the fire extinguishing agent 250 exits the fire extinguishing system 200 (at an exit plane 900A-900E, see FIGS. 9A and 9B) and enters, for example, engine compartment 115 (or other suitable compartment) and is exposed to ambient conditions. Although the temperature within at least a portion of the fire extinguishing system 200 may be substantially same as an ambient temperature, the pressures and velocities of the fire extinguishing agent 250 may be sufficient enough, within the portion of the fire extinguishing system 200 to drive the fire extinguishing agent 250 into a liquid state within the portion of the fire extinguishing system 200.

The fire extinguishing system 200 mechanically increases the temperature of the fire extinguishing agent to a temperature above the boiling point of the fire extinguishing agent 250. For example, the fire extinguishing system 200 may provide for cold environment operation down to temperatures as low as about −65° F. (54° C.) or lower. Examples of fire extinguishing agents that may be used in the fire extinguishing system 200 include any suitable fire extinguishing agent (or mixtures thereof) such as, but not limited to, Halon 1301 (having a boiling point of about −71° F. or about −57° C.), HFC-125 (pentafluoroethane, having a boiling point of about −55° F. or about −48° C.), CF3I (trifluoroiodomethane, having a boiling point of about −9° F. or about −23° C.), Novec™ 1230 (manufactured by 3M™, having a boiling point of about 120° F. or about 49° C.), and sodium bicarbonate ($NaHCO_3$).

The fire extinguishing system 200 employs a fire extinguishing agent 250 that is stored in a liquid form within a pressurized fluid storage container 210P. The pressurized fluid storage container 210P is configured to store the fire extinguishing agent 250 at pressures of about 100 psi to about 300 psi, or up to pressures of about 500 psi or greater. The fire extinguishing system 200 passively heats the fire extinguishing agent 250 as the fire extinguishing agent 250 is expelled from the fire extinguishing system 200, so that the liquid fire extinguishing agent 250 is vaporized and dispersed for extinguishing a fire. The passive heating of the fire extinguishing agent 250 is performed mechanically with a fluid stream separating device 290 (such as a vortex tube 260, also known as a Ranque-Hilsch vortex tube) that utilizes no moving or electrical parts and is powered by a fluid flow 600 (FIG. 6), of the fire extinguishing agent 250, passing through the device. The kinetic energy of the fluid flow 600 (e.g., which is a high speed fluid flow) passing through the vortex tube 260 is transformed into thermal energy which raises the temperature of at least a portion of the fluid flow, resulting in a hot peripheral fluid flow vortex 600HV (FIG. 6) and a cold axial fluid flow vortex 600CV (FIG. 6) within the vortex tube 260. The aspects of the present disclosure utilize the mechanical separation of the fire extinguishing agent 250 into a hot discharge component 250H (FIG. 6) and a cold discharge component 250C (FIG. 6) (where the hot discharge component 250H has a hotter temperature than the cold discharge component 250C) to cool hot surfaces and extinguish fires. The mechanical separation of the fire extinguishing agent 250 increases a temperature of the hot discharge component 250H to effect, in some aspects (see "Table 1" below), vaporization of the fire extinguishing agent in the cold environment (e.g., at ambient temperatures as low as about −65° F. (54° C.) or lower). As described below with respect to Table 1, the hot discharge component 250H and the cold discharge component 250C may be in either a liquid or vapor state.

Illustrative, non-exhaustive examples, which may or may not be claimed, of the subject matter according to the present disclosure are provided below.

In accordance with aspects of the present disclosure, the fire extinguishing system 200 may be used in any suitable application such as, for example, in dwellings, on vehicles (e.g., terrestrial, maritime, submersibles, aerospace, etc.), in outdoor environments, and in commercial or industrial (indoor or outdoor) environments. For ease of illustration, the aspects of the present disclosure will be described with respect to vehicle 100 illustrated in FIG. 1. The vehicle 100 is illustrated as a fixed wing aircraft but may be any suitable vehicle as noted above. The vehicle 100 includes fuselage 102 having a frame 100F, wings 106, and engines 108. The engines 108 are coupled to the wings 106 by a pylon 110 and include a nacelle 112. Each nacelle 112 forms an engine compartment 115 in which a fan 127 and a core 126 of a respective engine 108 are located. One or more fire zones 118 (e.g., predetermined areas, see FIGS. 1, 2A and 3B) are disposed within the engine compartment 115, where each fire zone 118 has one or more discharge(s) (integral discharge and/or remote discharge) of the fire extinguishing system 200 disposed therein. The vehicle 100 may also include an auxiliary power unit 135 disposed within an auxiliary power unit compartment 130 of the vehicle 100. The auxiliary power unit 135 may be any suitable on-board engine for generating auxiliary power for aircraft component (e.g., electric systems, hydraulic systems, ventilation systems, etc.) consumption while the engines 108 are not operating.

Referring to FIG. 2A, the fire extinguishing system 200 includes a fluid storage container 210A, 210B and one or more fluid stream separating devices 290. While two fluid storage containers 210A, 210B are illustrated in FIG. 2A more or less than two fluid storage containers 210A, 210B may be provided. The fluid storage container 210A, 210B is configured to store a fire extinguishing agent 250 in any suitable manner. For example, the fluid storage container 210A, 210B is a pressurized storage 210P that stores the fire extinguishing agent 250 as a cryogenic or non-cryogenic fluid (depending on characteristics, such as the boiling temperature, of the fire extinguishing agent 250 being used). The fluid storage container 210A, 210B includes any suitable fluid inlet 211 and pressure relief 212 for filling the fluid storage container 210A, 210B with the fire extinguishing agent 250 and to relieve excess pressure from the fluid storage container 210A, 210B.

The one or more fluid stream separating devices 290 are coupled to the fluid storage container 210A, 210B in any suitable manner. For example, any suitable conduit(s) 240, 241 couple the one or more fluid stream separating devices 290 to the fluid storage container 210A, 210B where the fire extinguishing agent 250 passes from the fluid storage container 210A, 210B, through the respective conduit(s) 240, 241 to the one or more fluid stream separating devices 290. In one aspect, the one or more fluid stream separating devices 290 respectively comprise a vortex tube 260. Here, the one or more fluid stream separating devices 290 are configured so that the fire extinguishing agent 250 passes through a respective fluid stream separating device 290 and the respective fluid stream separating device 290 raises a temperature of at least a portion 610 (FIG. 6) of the fire extinguishing agent 250 flowing through the respective fluid stream separating device 290 substantially at or above the boiling point of the fire extinguishing agent 250. The portion 610 of the fire extinguishing agent 250 that is above the boiling point may be discharged from the respective fluid separating device 290 as a vapor or liquid while another portion 611 (FIG. 6A) of the fire extinguishing agent 250 that is below the boiling point of the fire extinguishing agent 250 is discharged from the respective fluid separating device 290 as a vapor or liquid. Table 1A, Table 1B, and Table 1C (collectively referred to as Table 1) below illustrate the state (i.e., vapor or liquid) of the fire extinguishing agent 250 at various locations of the fluid stream separating device 290, including at exits (e.g., at a respective exit plane 900A-900E, see FIGS. 9A and 9B of the hot exit aperture 620 and the cold exit aperture 650) of the fire extinguishing system 200 to the ambient environment; however it should be understood that Table 1 is not an exhaustive list of possible states.

TABLE 1

| Location | Inlet 662 | Hot Exit Aperture 620 | Hot Flow Nozzle Exit Plane 900A, 900B, 900D | Hot Flow 901 in Engine Compartment 115 at Ambient Conditions | Cold Exit Aperture 650 | Cold Flow Nozzle Exit Plane 900C, 900E | Cold Flow 902 in Engine Compartment 115 at Ambient Conditions |
|---|---|---|---|---|---|---|---|
| Expected environmental conditions (about −65 F.) with expected performance end state | Liquid | Liquid | Liquid | Vapor | Vapor | Vapor | Liquid |
| Cold Bottle/Cold Compartment | Liquid | Liquid | Vapor | Vapor | Vapor | Vapor | Liquid |
| Cold Bottle/Warm Compartment | Liquid | Liquid | Vapor | Vapor | Vapor | Vapor | Vapor |
| Very cold bottle (hot exit aperture 620 below boiling point) | Liquid | Liquid | Liquid | Liquid | Liquid | Liquid | Liquid |
| Hot exit aperture 620 below boiling point | Liquid | Liquid | Liquid | Liquid | Vapor | Vapor | Liquid |
| Hot exit aperture 620 below boiling point (cold vapor condenses in exit tube) | Liquid | Liquid | Liquid | Liquid | Vapor | Liquid | Liquid |
| Cold exit aperture 650 and Hot exit aperture 620 above boiling point, warm bottle discharge | Vapor | Vapor | Vapor | Vapor | Vapor | Vapor | Vapor |
| Hot exit aperture 620 above boiling point, cold exit aperture 650 below boiling point/condenses in exit tube, warm bottle discharge | Vapor | Vapor | Vapor | Vapor | Vapor | Liquid | Liquid |

In Table 1, a "cold bottle" refers to the fluid storage container 210A, 210B having a fire extinguishing agent 250 at a temperature of about −65° F. (54° C.) to about the boiling point of the fire extinguishing agent 250. A "cold compartment" refers to compartment 115 having a temperature therein of about −65° F. (54° C.) to about the boiling point of the fire extinguishing agent 250. The term "very cold" refers to a temperature below about −65° F. (54° C.). The term "warm" refers to a temperature above the boiling point of the fire extinguishing agent 250. As an example, with respect to Table 1, where the engine compartment 115 and the fluid storage container 210A, 210B have a temperature of about −65° F. (54° C.), the cold axial fluid flow vortex 600CV (e.g., the cold fluid flow) and the hot peripheral fluid flow vortex 600HV (e.g., the hot fluid flow) are separated such that the hot peripheral fluid flow vortex 600HV, at the hot exit aperture 620 will be above the boiling point of the fire extinguishing agent 250 at the ambient conditions of the point of use (e.g., such as in the engine compartment 115) so as to be in a vapor state within the engine compartment 115; while the cold axial fluid flow vortex 600CV, at the cold exit aperture 650 will be below the boiling point of the fire extinguishing agent 250 so as to be in a liquid state within the engine compartment 115, due to energy extraction from the cold axial fluid flow vortex 600CV to the hot peripheral fluid flow vortex 600HV.

Figure 3A:
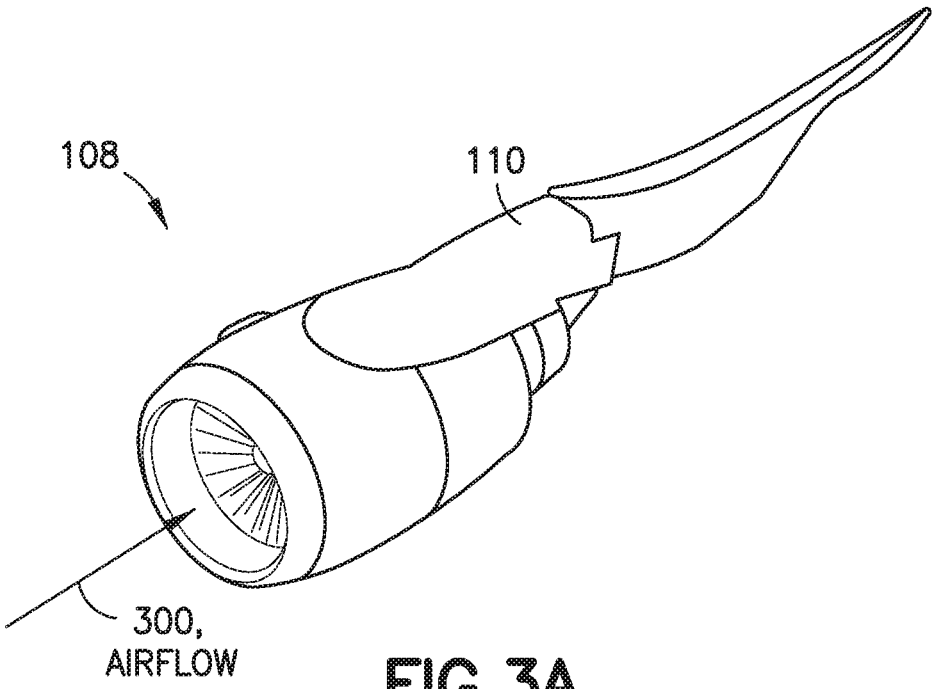

Referring to FIGS. 1 and 2A, the fire extinguishing system 200 is configured for the application of fire extinguishing agent 250 to one or more of the engines 108 of the vehicle 100. In FIG. 2A, the one or more fluid stream separating devices 290 are disposed within each of the engine compartments 115. The one or more fluid stream separating devices 290 are positioned to discharge the portion 610 (FIG. 6) of the fire extinguishing agent 250 that is above the boiling point, so that the fire extinguishing agent 250 is in the form of a vapor 270, into an air flow 300 (FIG. 3A) internal to the one or more fire zone 118 (FIG. 3A) passing through/around the engine 108, through the engine compartment 115, for extinguishing a fire. In one aspect, the one or more fluid stream separating devices 290 are positioned to discharge the portion 610 (FIG. 6) of the fire extinguishing agent 250 that is above the boiling point (e.g., as as a vapor 270 in the engine compartment 115) into the air flow 300 (FIG. 3A) in a direction that is perpendicular to the air flow 300 (FIG. 3A); while in other aspects, the fluid stream separating devices 290 are positioned to discharge the portion 610 (FIG. 6) of the fire extinguishing agent 250 at any suitable angle relative to the air flow 300 (FIG. 3A). In one aspect, the one or more fluid stream separating devices 290 are also positioned to discharge the other portion 611 (FIG. 6) of the fire extinguishing agent 250 that is below the boiling point as a liquid 271 onto a surface to be cooled, such as a surface 126S of the core 126; while in other aspects the other portion 611 may be directed to any suitable portion of the engine 108.

Figure 3B:
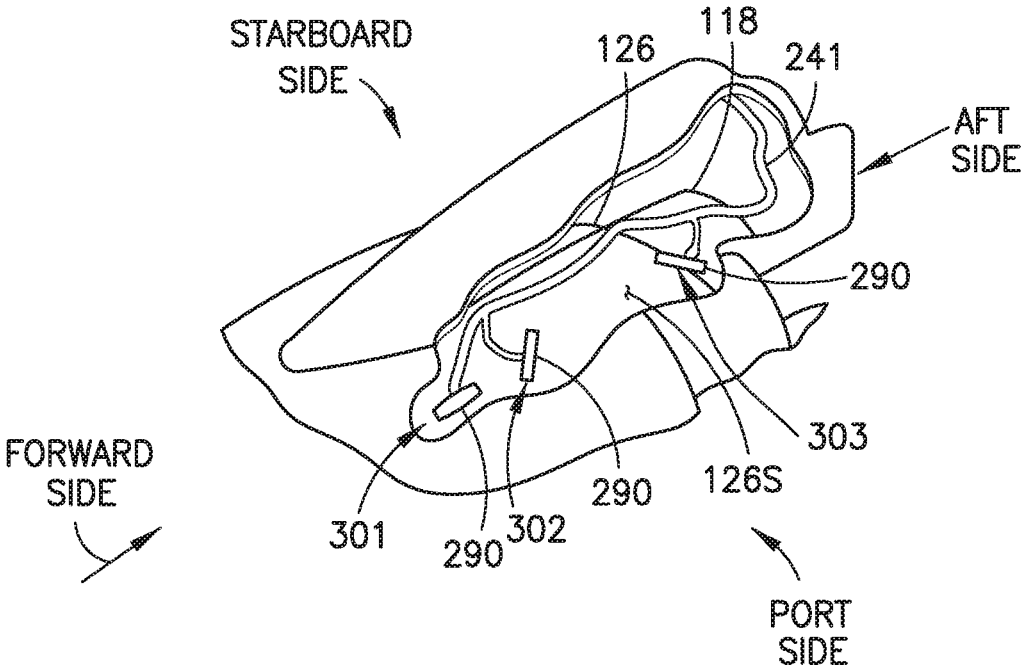
Figure 6A:
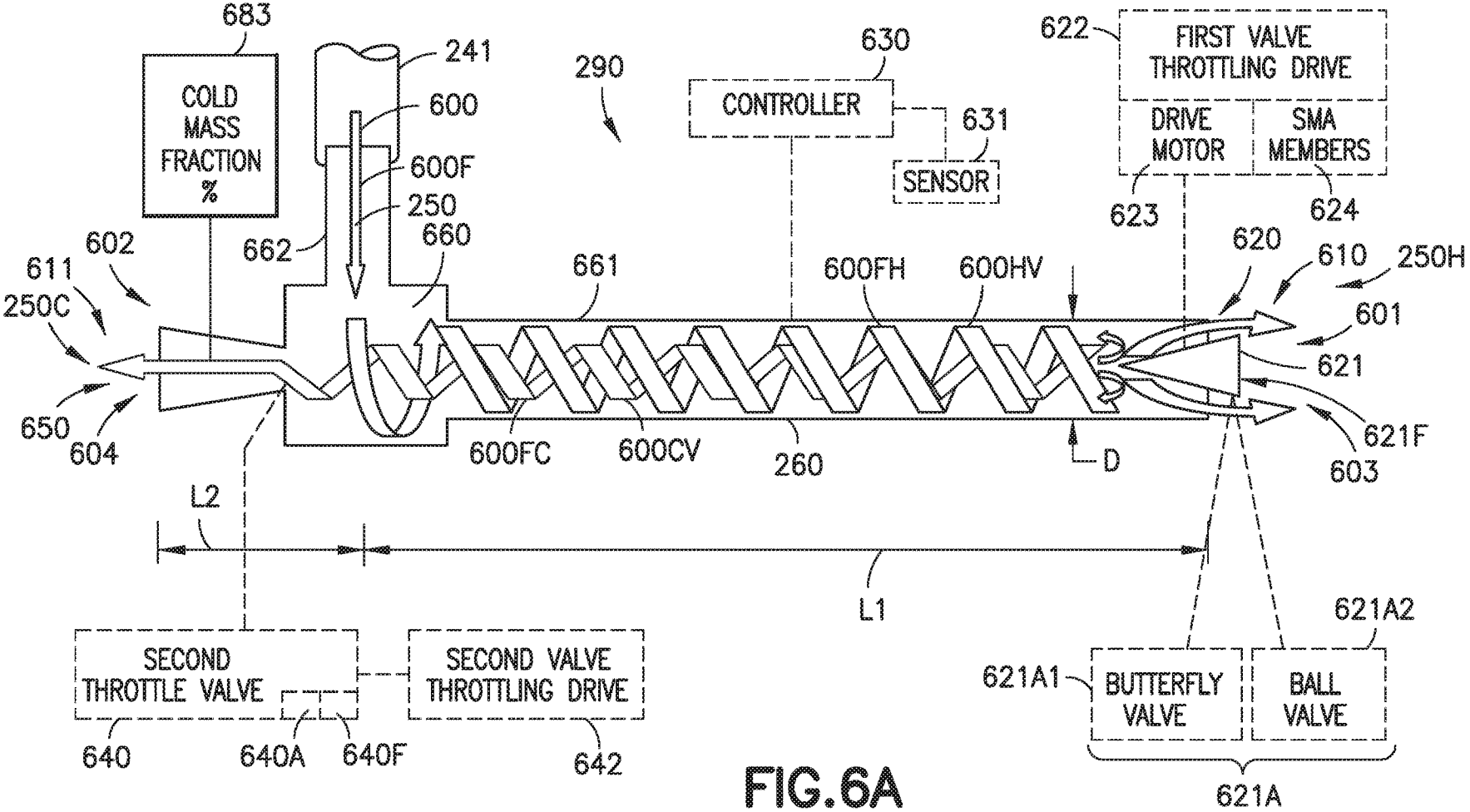

For example, referring to FIGS. 3A and 3B, the engine 108 on the starboard side of the vehicle is illustrated for exemplary purposes only. The one or more fluid stream separating devices 290 may be disposed within the engine compartment 115 (such as in fire zone 118) adjacent the forward side of the engine 108 and one or more fluid stream separating devices 290 may be disposed within the engine compartment 115 adjacent the aft side of the engine 108. The one or more fluid stream separating devices 290 are illustrated in FIG. 3B as being disposed on the port side of the engine 108 but it should be understood that the one or more fluid stream separating devices 290 may also be placed on the starboard side of the engine 108 as well. Each of the one or more fluid stream separating devices 290 is disposed adjacent the engine 108 (or auxiliary power unit 135) at a respective fire extinguishing agent discharge location 301, 302, 303 and includes at least one integral discharge nozzle 601, 602 (FIGS. 6A, 6B, 6C) to discharge the fire extinguishing agent 250 at the fire extinguishing agent discharge location 301, 302, 303. The at least one integral discharge nozzle 601, 602 (FIGS. 6A, 6B, 6C) includes a first discharge 603 (FIG. 6A) and a second discharge 604 (FIG. 6A).

Figure 4A:
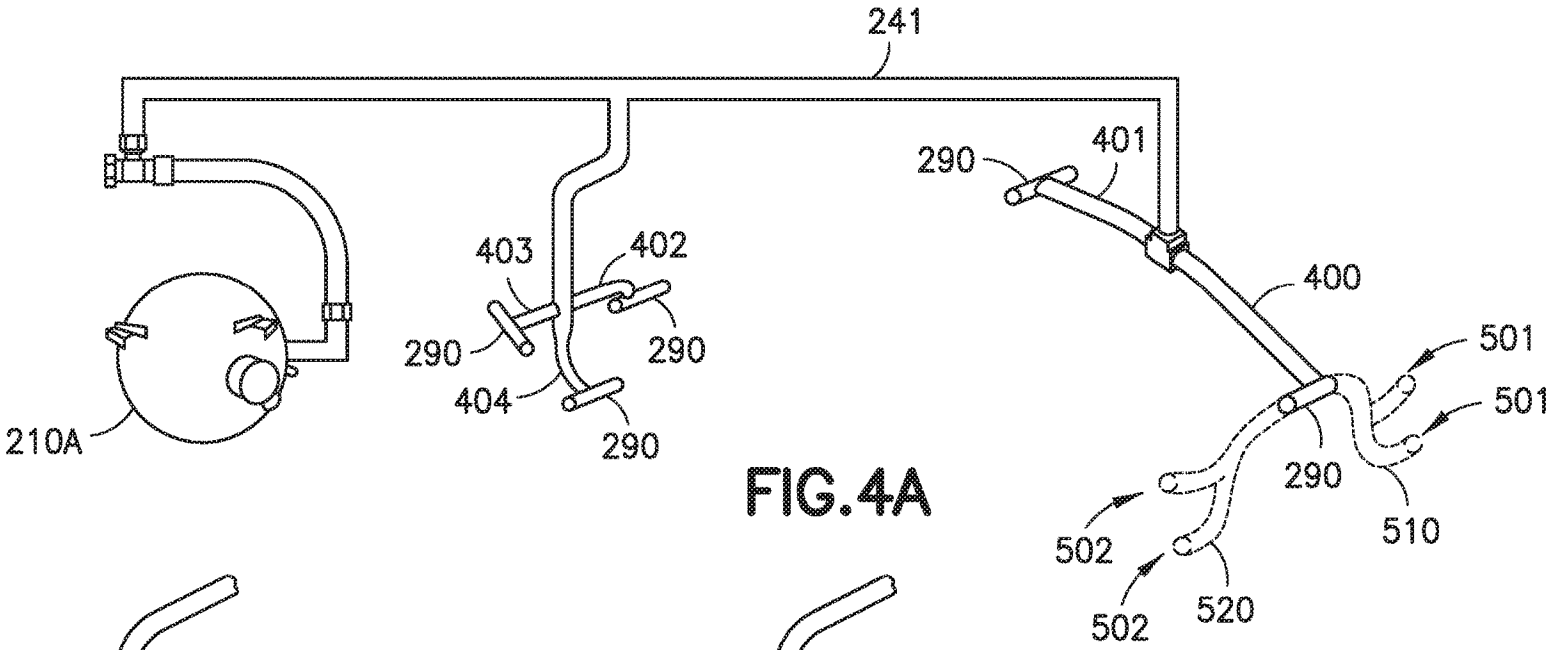
Figure 4C:
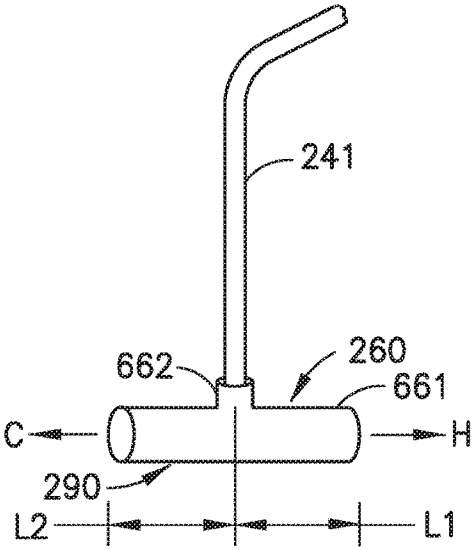
Figure 4B:
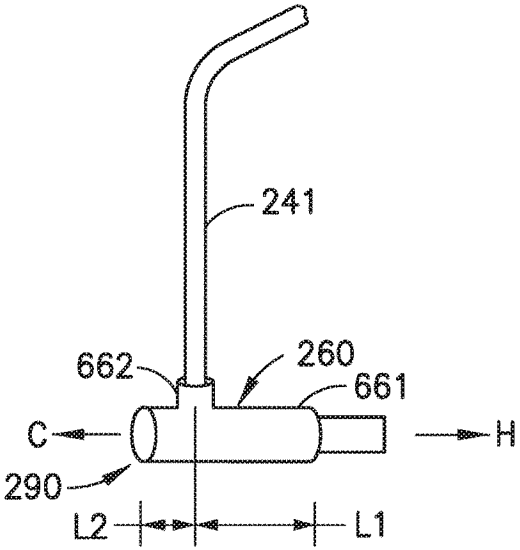
Figure 5:
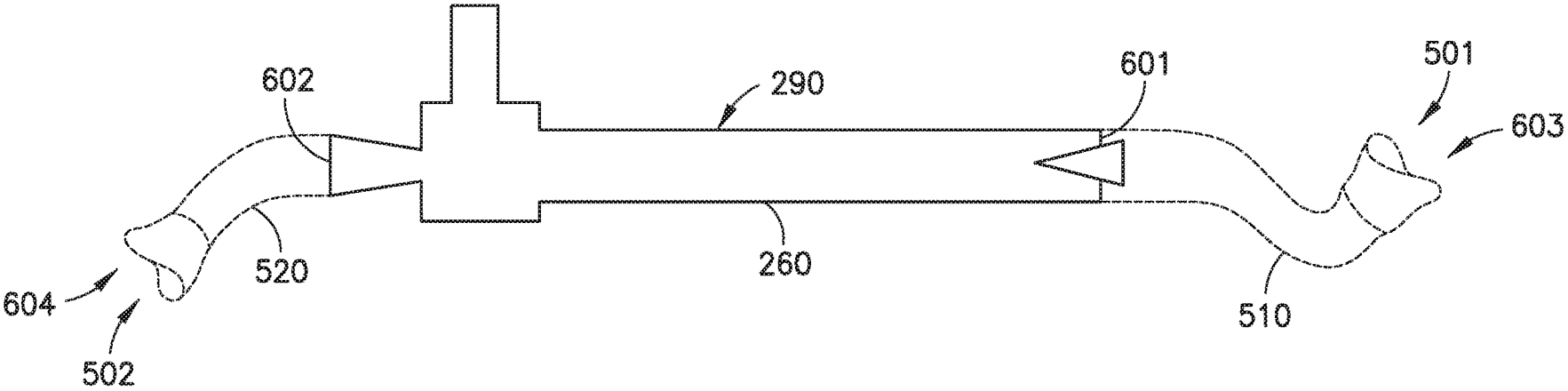

In other aspects, as can be seen in FIG. 5, at least one remote discharge nozzle 501, 502 may be coupled to the one or more fluid stream separating devices 290 in any suitable manner. For example, any suitable conduit 510, 520 may couple the at least one remote discharge nozzle 501, 502 to a respective integral discharge nozzle 601, 602 (FIG. 6) of the one or more fluid stream separating devices 290. One or more (see FIG. 4A) of the at least one remote discharge nozzle 501 is coupled to the one or more fluid stream separating devices 290 to discharge the fire extinguishing agent 250 in a vapor form, and one or more other (see FIG. 4A) of the at least one remote discharge nozzle 502 is coupled to the one or more fluid stream separating devices 290 to discharge the fire extinguishing agent 250 in a liquid form. Here, the utilization of the at least one remote discharge nozzle 501, 502 may provide placement of the at least one remote discharge nozzle 501, 502 in spaces that the one or more fluid stream separating devices 290 may not fit. The utilization of the at least one remote discharge nozzle 501, 502 may also provide for a greater separation distance between the first discharge 603 and the second discharge 604. Each of the at least one remote discharge nozzle 501, 502 may be disposed at a fire extinguishing agent discharge location (such as one or more of fire extinguishing agent discharge locations 301, 302, 303) in lieu of the associated one or more fluid stream separating devices 290. While remote discharge nozzles 501, 502 are shown coupled to a respective one of the integral discharge nozzle 601, 602; in other aspects remote discharge nozzle(s) 501, 502 may be coupled to only one of the integral discharge nozzles 601, 602.

Referring to FIGS. 1 and 2B, the fire extinguishing system 200 may be configured for the application of fire extinguishing agent 250 to the auxiliary power unit 135 (or any other suitable feature and/or area) of the vehicle 100. For example, in FIG. 2B, one or more fluid stream separating devices 290 are disposed within the auxiliary power unit compartment 130. Here, the one or more fluid stream separating devices 290 are positioned to discharge the portion 610 (FIG. 6) of the fire extinguishing agent 250 that is above the boiling point as a vapor 270 into the auxiliary power unit compartment 130 for extinguishing a fire. The one or more fluid stream separating devices 290 are also positioned to discharge the other portion 611 (FIG. 6) of the fire extinguishing agent 250 that is below the boiling point as a liquid 271 onto a surface to be cooled, such as a surface 135S of the auxiliary power unit 135. The one or more fluid stream separation devices 290 may be disposed within the auxiliary power unit compartment 130 in a manner substantially similar to that described herein with respect to the engine compartment 115.

Referring to FIGS. 2A and 4A, the conduits 240, 241 may have any suitable configuration for coupling any suitable number of the one or more fluid stream separating devices 290 to the fluid storage containers 210A, 210B. For example, referring to conduit 241 illustrated in FIG. 4A for exemplary purposes only (conduit 240 may be similarly configured), the conduit 241 includes one or more branch lines 400, 401, 402, 403, 404 to which the one or more fluid stream separating devices 290 may be coupled. As an example, the branch lines 400, 401 may span the engine 108 so that branch line 401 extends to the forward port side (FIG. 3B) of the engine and the branch line 400 extends to the forward starboard side (FIG. 3B) of the engine 108. The branch lines 402, 403, 404 may be disposed adjacent the aft side of the engine 108 around (e.g., starboard side, port side, underneath, and/or above) the core 126.

Referring to FIGS. 4B, 4C, 6A, 6B, and 6C, at least one of the one or more fluid stream separating devices 290 are constructed of any suitable material configured to withstand the pressures (e.g., inlet 662 pressures of greater than about 100 psi) and temperatures at which the one or more fluid stream separating devices 290 are operated. For example, the one of the one or more fluid stream separating devices 290 may be constructed of steel, titanium, etc. The at least one of the one or more fluid stream separating devices 290 are also configured for one or more of manual and automatic manipulation of one or more predetermined characteristics of the fire extinguishing agent 250 flowing through the at least one of the one or more fluid stream separating devices 290. The predetermined characteristics include, but are not limited to, a temperature of the fire extinguishing agent 250, a mass flow of the fire extinguishing agent 250, and liquid and vapor mass states of the fire extinguishing agent 250. For example, as described herein, the fluid stream separating devices 290 comprise vortex tubes 260. Each vortex tube includes a vortex chamber portion 660 and a tube portion 661. An inlet 662 extends from the vortex chamber portion 660 and is configured to couple the vortex tube 260 to a conduit 240, 241 (see also FIG. 2A). As described above, the vortex tube 260 includes an integral (hot) discharge nozzle 601 at the first discharge 603 and another integral (cold) discharge nozzle 602 at the second discharge 604. Each fluid stream separating device 290 is configured to mechanically separate the fire extinguishing agent 250 flowing through the fluid stream separating device 290 into the hot discharge component 250H and the cold discharge component 250C, where the hot discharge component 250H has a temperature above the boiling point of the fire extinguishing agent 250. The fluid stream separating device 290 is configured to increase the temperature of the hot discharge component 250H to above the boiling point through a conservation of enthalpy as the fire extinguishing agent 250 is being discharged from the fire extinguishing system 200 (FIGS. 2A and 2B).

The integral (hot) discharge nozzle 601 (or a remote discharge nozzle(s) coupled thereto) discharges the hot discharge component 250H into the engine compartment 115 so that the hot discharge component 250H is in one of vapor state or a liquid state as noted above with respect to Table 1. The integral (hot) discharge nozzle 601 includes a hot exit aperture 620, the size of which is determined by a first throttle valve 621. The first throttle valve 621 is, in one aspect, a fixed valve 621F where the size of the hot exit aperture 620 is set and does not change. In other aspects, the first throttle valve 621 may be an adjustable valve 621A, such as a butterfly valve 621A1, a ball valve 621A2 or an adjustable plug valve (substantially similar in shape to the fixed valve 621F but axially moveable in and out of the tube portion 661). The adjustable valve 621A may be driven in any suitable manner such as manually or automatically by a first valve throttling drive 622. The first valve throttling drive 622 may include one or more of a drive motor 623, shape memory alloy (SMA) members 624 or any other suitable actuator for throttling the first throttle valve 621 and changing a size of the hot exit aperture 620. A controller 630 may be coupled to the vortex tube 260 (e.g., to the first valve throttling drive 622) and include any suitable non-transitory computer program code and structure (e.g., processors, memory, etc.) for operating the first throttle valve 621 to change a size of the hot exit aperture 620, depending on, for example, environmental conditions in which the fire extinguishing system 200 (FIGS. 2A, 2B) operates. The controller 630 may be configured to operate the first throttle valve 621 based on sensor 631 signals where the sensor senses the environmental conditions and/or under control of a human operator and/or other command data.

The integral (cold) discharge nozzle 602 (or a remote discharge nozzle(s) coupled thereto) discharges the cold discharge component 250C into the engine compartment 115 so that the cold discharge component 250C is in one of a vapor or liquid state within the compartment 115 as noted above in Table 1. Similarly, the integral (cold) discharge nozzle 602 may include a second throttle valve 640 that is substantially similar to the first throttle valve 621 (e.g., at least from the standpoint of being either fixed or adjustable) for setting or adjusting a size of a cold exit aperture 650 of the integral (cold) discharge nozzle 602. Where the second throttle valve 640 is adjustable, the second throttle valve 640 may be automatically driven by a second valve throttling drive 642 in a manner similar to that described above with respect to the first valve throttling drive 622 (where the controller 630 is configured to operate the second throttle valve 640 in the manner described above).

Where at least of the first throttle valve 621 and the second throttle valve 640 are fixed, the at least one fixed valve 621F, 640F at least in part defines a temperature difference between the portion 610 of the fire extinguishing agent 250 flowing through the respective fluid stream separating device 290 above the boiling point of the fire extinguishing agent 250 and the other portion 611 of the fire extinguishing agent 250 flowing through the respective fluid stream separating device 290 below the boiling point of the fire extinguishing agent 250. Where at least of the first throttle valve 621 and the second throttle valve 640 are movable/adjustable, the adjustable valve 621A, 640A varies an outlet size of the respective hot exit aperture 620 and cold exit aperture 650 of the respective fluid stream separating device 290 to vary a temperature difference and/or a mass flow between the portion 610 of the fire extinguishing agent 250 flowing through the respective fluid stream separating device 290 above the boiling point of the fire extinguishing agent 250 and the other portion 611 of the fire extinguishing agent 250 flowing through the respective fluid stream separating device 290 below the boiling point of the fire extinguishing agent 250.

Referring to FIG. 6A, as noted herein, the fluid stream separating device is configured to manipulate any suitable characteristic of the fire extinguishing agent 250 such as those described above. As an example, the temperature of the fire extinguishing agent 250, the mass flow of the fire extinguishing agent 250, and the liquid and vapor mass states of the fire extinguishing agent 250, may be manipulated (e.g., raised/increased or lowered/decreased) by one or more of increasing or decreasing one or more of the lengths L1, L2 of the tube portion 661 of the fluid stream separating device 290. For example, increasing at least the length L1 of the tube portion 661 may provide for increased interaction between the hot peripheral fluid flow vortex 600HV and the cold axial fluid flow vortex 600CV so that as the length L1 increases more heat is extracted from the cold axial fluid flow vortex 600CV by the hot peripheral fluid flow vortex 600HV to increase a temperature of the portion 610 of the fire extinguishing agent 250 exiting the hot exit aperture 620 (and decrease a temperature of the portion 611 of the fire extinguishing agent 250 exiting the cold exit aperture 650). As an example a length L1 to diameter D ratio of the tube portion 661 is in one aspect, about 20:1, but in other aspects the length L1 to diameter D ratio may be more or less than about 20:1.

Decreasing or increasing the size of the hot exit aperture 620 (and/or the cold exit aperture 650) also manipulates the temperature of the portions 610, 611 of the fire extinguishing agent 250 exiting the hot exit aperture 620 and the cold exit aperture 650. For example, the smaller the hot exit aperture 620 (or the larger the cold exit aperture 650), the hotter the temperature of the portion 610 of the fire extinguishing agent 250 exiting the hot exit aperture 620 and vice versa. As noted above, the aperture sizes of the hot exit aperture 620 and/or cold exit aperture 650 may be fixed (e.g., not movable/adjustable) while in other aspects the aperture sizes are movable so as to be automatically or manually adjustable. The hotter the portion 610 of the fire extinguishing agent 250 exiting the hot exit aperture 620, the greater the vaporization and spreading of the fire extinguishing agent into the air flow (300 (FIG. 3A) through, for example, the engine 108 or into the auxiliary power unit compartment 130 (FIG. 2B).

Increasing or decreasing a size of at least the hot exit aperture 620 also manipulates the liquid and vapor mass states (i.e., the cold mass fraction percentage 683 of fire extinguishing agent 250 flowing through the fluid stream separating device 290) and mass flow 600F of the fire extinguishing agent flowing through the fluid stream separating device 290. For example, the larger the size of the hot exit aperture 620 (or the smaller the size of the cold exit aperture 650), the greater mass flow 600FH of the portion 610 of the fire extinguishing agent 250 exiting the hot exit aperture (with a corresponding decrease in mass flow 600FC of the portion 611 of the fire extinguishing agent 250 exiting the cold exit aperture 650 and decrease in temperature of the portion 610 exiting the hot exit aperture 620) and vice versa. As another example, the greater the cold mass fraction percentage 683 (i.e., the percentage of the portion 611 compared to the portion 610 flowing through the fluid stream separation device 290 as determined by the exit aperture sizes), the greater the temperature difference between the fire extinguishing agent 250 fluid flow at the hot exit aperture 620 and the cold exit aperture 650 of the fluid stream separating device. For example, a cold mass fraction of about 0.8 (e.g., 80%) may produce about a 140° F. (60° C.) temperature difference between the fire extinguishing agent 250 discharged from the hot exit aperture 620 and the fire extinguishing agent 250 discharged from the cold exit aperture 650 at an inlet 662 pressure of about 120 psi.

Where the size of one or more of the hot exit aperture 620 and the cold exit aperture 650 are adjustable, as noted above, one or more of the above-described predetermined characteristics of the fire extinguishing agent 250 may be adjusted depending on the environment in which the fluid stream separating device is disposed. For example, where the engine compartment 115 (FIG. 2A) and/or the auxiliary power unit compartment 130 (FIG. 2B) are cold-soaked (e.g., exposed to ambient conditions such that the compartment and equipment no longer contain any residual heat from operation), one or more of the first throttle valve 621 and the second throttle valve 640 may be driven by the respective first valve throttling drive 622 and second valve throttling drive 642 so that a size of the respective hot exit aperture 620 and cold exit aperture 650 is adjusted to provide an effective concentration/spread and performance of the fire extinguishing agent at the cold-soaked ambient conditions.

Figure 6B:
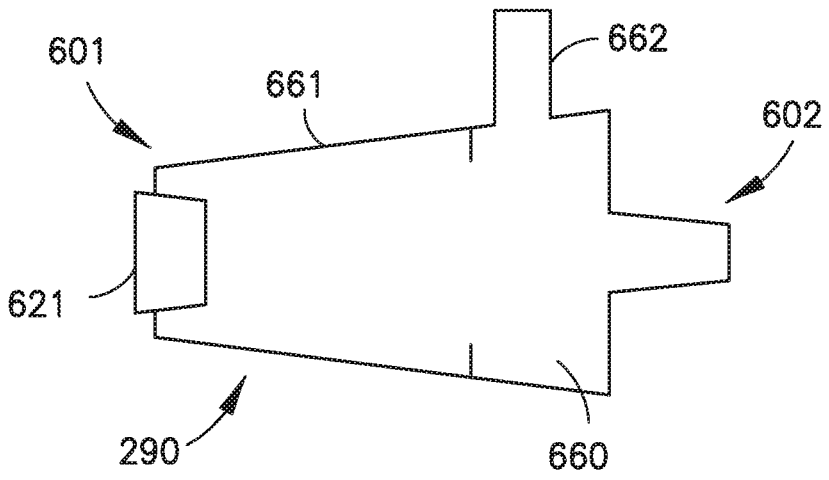
Figure 6C:
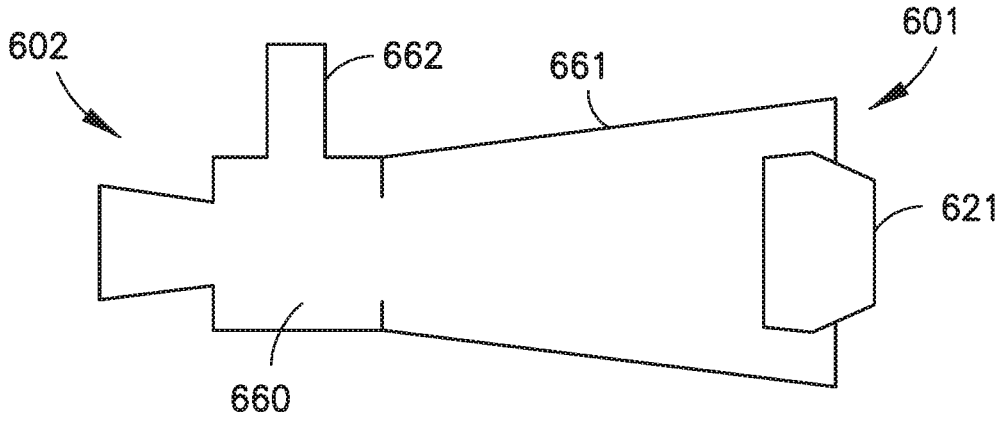

As can also be seen in FIGS. 6B and 6C, one or more of the integral (hot) discharge nozzle 601 and the integral (cold) discharge nozzle 602 may be a converging nozzle (FIG. 6B). The converging nozzle(s) may increase the flow rate of the fire extinguishing agent 250 exiting (FIG. 6A) there through (for sub-sonic fluid flows) which may increase dispersion of the fire extinguishing agent 250 by propelling the fire extinguishing agent further into the air flow 300 (FIG. 3A) or further into the engine compartment 115 (FIG. 2A) and/or the auxiliary power unit compartment 130 (FIG. 2B). The diverging nozzle(s) may slow down the flow rate of the fire extinguishing agent 250 exiting (FIG. 6A) there through (for sub-sonic fluid flows) which may increase dispersion of the fire extinguishing agent 250 by widening/broadening the stream of fire extinguishing agent over a predetermined target area and/or volume.

Referring now to FIGS. 1, 2A, 2B, 6A and 7, a method of using the fire extinguishing system 200 will be described. A fire extinguishing agent 250 is stored in a fluid storage container 210A, 210B (FIG. 7, Block 700). The fire extinguishing agent 250 flowing through the fluid stream separating device 290 is mechanically separated, by the fluid stream separating device 290, into a hot discharge component 250H and a cold discharge component 250C, where at least a portion of the hot discharge component 250H has a temperature above a boiling point of the fire extinguishing agent 250 (FIG. 7, Block 710). In one aspect, one or more one or more predetermined characteristics of the fire extinguishing agent 250 flowing through the one or more fluid stream separating devices 290 is manually or automatically manipulated with the one or more fluid stream separating devices 290 (FIG. 7, Block 720). For example, a temperature of the fire extinguishing agent 250 flowing through the one or more fluid stream separating devices 290 may be increased or decreased as described herein. For example, the temperature of the hot discharge component 250H may be increased to above the boiling point of the fire extinguishing agent 250 through a conservation of enthalpy as the fire extinguishing agent 250 is being discharged from the fire extinguishing system 200. A mass flow of the fire extinguishing agent 250 flowing through the one or more fluid stream separating devices 290 may be increased or decreased as described herein. Liquid and vapor mass states of the fire extinguishing agent 250 flowing through the one or more fluid stream separating devices 290 may be increased or decreased as described herein.

The hot discharge component 250H and the cold discharge component 250C of the fire extinguishing agent 250 are discharged (FIG. 7, Block 730) through a respective discharge nozzle 601, 602 coupled to the fluid stream separating device 290. The fire extinguishing agent 250 is discharged at a fire extinguishing agent discharge location 301, 302, 303 (FIG. 3B) with at least one integral discharge nozzle 601, 602 (or through a remote discharge nozzle 501, 502—FIG. 5) of a respective fluid stream separating device 290. For example, the hot discharge component 250H of the fire extinguishing agent 250, that is above the boiling point, is discharged as a vapor or liquid according to Table 1 above (i.e., the first discharge 603) into an air flow 300 (FIG. 3A) within a fire zone 118 of an engine 108 for extinguishing a fire. The cold discharge component 250C of the fire extinguishing agent 250, that is below the boiling point, is discharged as a liquid or a vapor according to Table 1 above (i.e., the second discharge 604) onto a surface 126S of the engine 108 (e.g., or any other suitable heat source(s)) to be cooled where the liquid may be presented as a mist (e.g., liquid droplets with some atomization) in the direction of the suitable heat source(s), where the mist is vaporized (as noted above in Table 1) adjacent the heat source(s).

Referring now to FIGS. 1, 2A, 2B, 6A and 8, a method of using the fire extinguishing system 200 will be described.

The fire extinguishing agent 250 is stored in a fluid storage container 210A, 210B (FIG. 8, Block 800). A temperature of at least a portion 610 of the fire extinguishing agent 250 flowing through the one or more vortex tubes 260 is raised, with the one or more vortex tubes coupled to the fluid storage container, above a boiling point of the fire extinguishing agent 250 (FIG. 8, Block 810). In one aspect, one or more one or more predetermined characteristics of the fire extinguishing agent 250 flowing through the one or more fluid stream separating devices 290 is manually or automatically manipulated with the one or more fluid stream separating devices 290 (FIG. 8, Block 820). For example, a temperature of the fire extinguishing agent 250 flowing through the one or more fluid stream separating devices 290 may be increased or decreased as described herein. For example, the temperature of the hot discharge component 250H may be increased to above the boiling point of the fire extinguishing agent 250 through a conservation of enthalpy as the fire extinguishing agent 250 is being discharged from the fire extinguishing system 200. A mass flow of the fire extinguishing agent 250 flowing through the one or more fluid stream separating devices 290 may be increased or decreased as described herein. Liquid and vapor mass states of the fire extinguishing agent 250 flowing through the one or more fluid stream separating devices 290 may be increased or decreased as described herein; noting that the total mass flow through the fluid stream separating device 290 is conserved between the fluid inlet 211 and the combination of both discharge nozzles (e.g., the integral hot and cold discharge nozzles 601, 602/hot and cold exit apertures 620, 650).

The hot discharge component 250H and the cold discharge component 250C of the fire extinguishing agent 250 are discharged (FIG. 7, Block 830) through a respective integral discharge nozzle 601, 602 (or remote discharge nozzle—see FIG. 5) coupled to the fluid stream separating device 290. The fire extinguishing agent 250 is discharged at a fire extinguishing agent discharge location 301, 302, 303 (FIG. 3B) within a respective fire zone 118 with at least one integral discharge nozzle 601, 602 (or through a remote discharge nozzle 501, 502—FIG. 5) of a respective fluid stream separating device 290. For example, the hot discharge component 250H of the fire extinguishing agent 250, that is above the boiling point, is discharged into an air flow 300 (FIG. 3A) within a fire zone 118 of an engine 108 for extinguishing a fire. The cold discharge component 250C of the fire extinguishing agent 250, that is below the boiling point, is discharged as a liquid or a vapor according to Table 1 above onto a surface 126S of the engine 108 to be cooled.

The following examples are provided in accordance with the aspects of the present disclosure:

A1. A fire extinguishing system comprising:

a fluid storage container configured to store a fire extinguishing agent; and a vortex tube coupled to the fluid storage container, where the fire extinguishing agent passes from the fluid storage container through the vortex tube so that the vortex tube raises a temperature of at least a portion of the fire extinguishing agent flowing through the vortex tube above a boiling point of the fire extinguishing agent at ambient environmental conditions of a discharge location of the vortex tube.

A2. The fire extinguishing system of paragraph A1, wherein the vortex tube is disposed at a fire extinguishing agent discharge location and includes at least one integral discharge nozzle to discharge the fire extinguishing agent at the fire extinguishing agent discharge location.

A3. The fire extinguishing system of paragraph A2, wherein the at least one integral discharge nozzle includes one or more of a vapor discharge and a liquid discharge.

A4. The fire extinguishing system of any one of paragraphs A1-A3, further comprising at least one remote discharge nozzle coupled to the vortex tube, each of the at least one remote discharge nozzle being disposed at a fire extinguishing agent discharge location.

A5. The fire extinguishing system of paragraph A4, wherein:

one of the at least one remote discharge nozzle is coupled to the vortex tube to discharge a hot discharge component of the fire extinguishing agent in one of a vapor form and a liquid form, and another of the at least one remote discharge nozzle is coupled to the vortex tube to discharge a cold discharge component of the fire extinguishing agent in one of a vapor form and a liquid form.

A6. The fire extinguishing system of any one of paragraphs A1-A5, wherein the vortex tube is positioned to:

discharge the portion of the fire extinguishing agent that is above the boiling point as one of a vapor and a liquid into an air flow for extinguishing a fire, and discharge another portion of the fire extinguishing agent that is below the boiling point as one of a vapor and a liquid onto a surface to be cooled.

A7. The fire extinguishing system of any one of paragraphs A1-A6, wherein the fluid storage container comprises a pressurized storage.

A8. The fire extinguishing system of any one of paragraphs A1-A7, wherein the vortex tube includes at least one fixed valve that defines a temperature difference between the portion of the fire extinguishing agent flowing through the vortex tube above the boiling point of the fire extinguishing agent and another portion of the fire extinguishing agent flowing through the vortex tube below the boiling point of the fire extinguishing agent.

A9. The fire extinguishing system of any one of paragraphs A1-A8, wherein the vortex tube includes at least one movable valve that varies an outlet size of the vortex tube to vary a temperature difference between the portion of the fire extinguishing agent flowing through the vortex tube above the boiling point of the fire extinguishing agent and another portion of the fire extinguishing agent flowing through the vortex tube below the boiling point of the fire extinguishing agent.

A10. The fire extinguishing system of any one of paragraphs A1-A9, wherein the vortex tube is configured for manual manipulation of one or more predetermined characteristics of the fire extinguishing agent flowing through the vortex tube.

A11. The fire extinguishing system of any one of paragraphs A1-A10, wherein the vortex tube is configured for automatic manipulation of one or more predetermined characteristics of the fire extinguishing agent flowing through the vortex tube.

A12. The fire extinguishing system of any one of paragraphs A1-A11, wherein the vortex tube is configured to manipulate a temperature of the fire extinguishing agent flowing through the vortex tube.

A13. The fire extinguishing system of any one of paragraphs A1-A12, wherein the vortex tube is configured to manipulate a mass flow of the fire extinguishing agent flowing through the vortex tube.

A14. The fire extinguishing system of any one of paragraphs A1-A13, wherein the vortex tube is configured to manipulate liquid and vapor mass states of the fire extinguishing agent flowing through the vortex tube.

A15. The fire extinguishing system of any one of paragraphs A1-A14, wherein the vortex tube is one of a plurality of vortex tubes coupled to the fluid storage container.

B1. A fire extinguishing system for a vehicle having an engine, the fire extinguishing system comprising:

a fluid storage container configured to store a fire extinguishing agent; and a fluid stream separating device coupled to the fluid storage container, the fluid stream separating device being configured to mechanically separate the fire extinguishing agent flowing through the fluid stream separating device into hot discharge component and a cold discharge component, where the hot discharge component has a temperature above a boiling point of the fire extinguishing agent at ambient environmental conditions of a discharge location of the fluid stream separating device.

B2. The fire extinguishing system of paragraph B1, wherein the fluid stream separating device is configured to increase the temperature of at least a portion of the hot discharge component to above the boiling point through a conservation of enthalpy as the fire extinguishing agent is being discharged from the fire extinguishing system.

B3. The fire extinguishing system of any one of paragraphs B1-B2, wherein the fluid stream separating device comprises a vortex tube.

B4. The fire extinguishing system of paragraph B3, wherein the vortex tube includes at least one fixed valve that defines a temperature difference between the hot discharge component of the fire extinguishing agent flowing through the vortex tube above the boiling point and the cold discharge component of the fire extinguishing agent flowing through the vortex tube below the boiling point of the fire extinguishing agent.

B5. The fire extinguishing system of paragraph B3, wherein the vortex tube includes at least one movable valve that varies an outlet size of the vortex tube to vary a temperature difference between the hot discharge component of the fire extinguishing agent flowing through the vortex tube above the boiling point of the fire extinguishing agent and the cold discharge component of the fire extinguishing agent flowing through the vortex tube below the boiling point of the fire extinguishing agent.

B6. The fire extinguishing system of any one of paragraphs B1-B5, wherein the fluid stream separating device is disposed adjacent the engine at a fire extinguishing agent discharge location, the fluid stream separating device includes at least one integral discharge nozzle to discharge the fire extinguishing agent at the fire extinguishing agent discharge location.

B7. The fire extinguishing system of paragraph B6, wherein the at least one integral discharge nozzle includes one or more of a vapor discharge and a liquid discharge.

B8. The fire extinguishing system of any one of paragraphs B1-B7, further comprising at least one remote discharge nozzle coupled to the fluid stream separating device, each of the at least one remote discharge nozzle being disposed adjacent the engine at a fire extinguishing agent discharge location.

B9. The fire extinguishing system of paragraph B8, wherein:

one of the at least one remote discharge nozzle is coupled to the fluid stream separating device to discharge one of the hot discharge component and the cold discharge component of the fire extinguishing agent, and another of the at least one remote discharge nozzle is coupled to the fluid stream separating device to discharge another of the hot discharge component and the cold discharge component of the fire extinguishing agent.

B10. The fire extinguishing system of any one of paragraphs B1-B9, wherein the fluid stream separating device is positioned to:

discharge the hot discharge component of the fire extinguishing agent that is above the boiling point as one of a vapor and a liquid into an air flow adjacent the engine for extinguishing a fire, and discharge the cold discharge component of the fire extinguishing agent that is below the boiling point as one of a vapor and a liquid onto a surface of the engine to be cooled.

B11. The fire extinguishing system of any one of paragraphs B1-B10, wherein the fluid storage container comprises a pressurized storage.

B12. The fire extinguishing system of any one of paragraphs B1-B11, wherein the fluid stream separating device is configured for manual manipulation of one or more predetermined characteristics of the fire extinguishing agent flowing through the fluid stream separating device.

B13. The fire extinguishing system of any one of paragraphs B1-B12, wherein the fluid stream separating device is configured for automatic manipulation of one or more predetermined characteristics of the fire extinguishing agent flowing through the fluid stream separating device.

B14. The fire extinguishing system of any one of paragraphs B1-B14, wherein the fluid stream separating device is configured to manipulate a temperature of the fire extinguishing agent flowing through the fluid stream separating device.

B15. The fire extinguishing system of any one of paragraphs B1-B14, wherein the fluid stream separating device is configured to manipulate a mass flow of the fire extinguishing agent flowing through the fluid stream separating device.

B16. The fire extinguishing system of any one of paragraphs B1-B15, wherein the fluid stream separating device is configured to manipulate liquid and vapor mass states of the fire extinguishing agent flowing through the fluid stream separating device.

C1. A fire extinguishing system comprising:

a fluid storage container configured to store a fire extinguishing agent; and a fluid stream separating device coupled to the fluid storage container, where the fire extinguishing agent passes from the fluid storage container through the fluid stream separating device so that the fluid stream separating device raises a temperature of at least a portion of the fire extinguishing agent flowing through the fluid stream separating device above a boiling point of the fire extinguishing agent at ambient environmental conditions of a discharge location of the fluid stream separating device.

C2. The fire extinguishing system of paragraph C1, wherein the fluid stream separating device is disposed at a fire extinguishing agent discharge location and includes at least one integral discharge nozzle to discharge the fire extinguishing agent at the fire extinguishing agent discharge location.

C3. The fire extinguishing system of paragraph C2, wherein the at least one integral discharge nozzle includes one or more of a vapor discharge and a liquid discharge.

C4. The fire extinguishing system of any one of paragraphs C1-C3, further comprising at least one remote discharge nozzle coupled to the fluid stream separating device, each of the at least one discharge nozzle being disposed at a fire extinguishing agent discharge location.

C5. The fire extinguishing system of paragraph C4, wherein:

one of the at least one remote discharge nozzle is coupled to the fluid stream separating device to discharge a hot discharge component of the fire extinguishing agent in one of a vapor form and a liquid form, and another of the at least one remote discharge nozzle is coupled to the fluid stream separating device to discharge a cold discharge component of the fire extinguishing agent in one of a vapor form and a liquid form.

C6. The fire extinguishing system of any one of paragraphs C1-05, wherein the fluid stream separating device is positioned to:

discharge the portion of the fire extinguishing agent that is above the boiling point as one of a vapor and a liquid into an air flow for extinguishing a fire, and discharge another portion of the fire extinguishing agent that is below the boiling point as one of a vapor and a liquid onto a surface to be cooled.

C7. The fire extinguishing system of any one of paragraphs C1-C6, wherein the fluid storage container comprises a pressurized storage.

C8. The fire extinguishing system of paragraph C1-C7, wherein the fluid stream separating device includes at least one fixed valve that defines a temperature difference between the portion of the fire extinguishing agent flowing through the fluid stream separating device above the boiling point of the fire extinguishing agent and another portion of the fire extinguishing agent flowing through the fluid stream separating device below the boiling point of the fire extinguishing agent.

C9. The fire extinguishing system of any one of paragraphs C1-C8, wherein the fluid stream separating device includes at least one movable valve that varies an outlet size of the fluid stream separating device to vary a temperature difference between the portion of the fire extinguishing agent flowing through the fluid stream separating device above the boiling point of the fire extinguishing agent and another portion of the fire extinguishing agent flowing through the fluid stream separating device below the boiling point of the fire extinguishing agent.

C10. The fire extinguishing system of any one of paragraphs C1-C9, wherein the fluid stream separating device is configured to mechanically separate the fire extinguishing agent flowing through the fluid stream separating device into a vapor component and a liquid component, where the vapor component has a temperature above the boiling point of the fire extinguishing agent.

C11. The fire extinguishing system of any one of paragraphs C1-C10, wherein the fluid stream separating device is configured for manual manipulation of one or more predetermined characteristics of the fire extinguishing agent flowing through the fluid stream separating device.

C12. The fire extinguishing system of any one of paragraphs C1-C11, wherein the fluid stream separating device is configured for automatic manipulation of one or more predetermined characteristics of the fire extinguishing agent flowing through the fluid stream separating device.

C13. The fire extinguishing system of any one of paragraphs C1-C12, wherein the fluid stream separating device is configured to manipulate a temperature of the fire extinguishing agent flowing through the fluid stream separating device.

C14. The fire extinguishing system of any one of paragraphs C1-C13, wherein the fluid stream separating device is configured to manipulate a mass flow of the fire extinguishing agent flowing through the fluid stream separating device.

C15. The fire extinguishing system of any one of paragraphs C1-C14, wherein the fluid stream separating device is configured to manipulate liquid and vapor mass states of the fire extinguishing agent flowing through the fluid stream separating device.

C16. The fire extinguishing system of any one of paragraphs C1-C15, wherein the fluid stream separating device comprises a vortex tube.

C17. The fire extinguishing system of any one of paragraphs C1-C16, wherein the fluid stream separating device is one of a plurality of fluid stream separating devices coupled to the fluid storage container.

D1. A method of using a fire extinguishing system, the method comprising:

storing a fire extinguishing agent in a fluid storage container; and mechanically separating, with a fluid stream separating device coupled to the fluid storage container, the fire extinguishing agent flowing through the fluid stream separating device into a hot discharge component and a cold discharge component, where the hot discharge component has a temperature above a boiling point of the fire extinguishing agent at ambient environmental conditions of a discharge location of the fluid stream separating device.

D2. The method of paragraph D1, further comprising increasing the temperature of at least a portion of the hot discharge component to above the boiling point through a conservation of enthalpy as the fire extinguishing agent is being discharged from the fire extinguishing system.

D3. The method of any one of paragraphs D1-D2, further comprising:

discharging the hot discharge component of the fire extinguishing agent through one discharge nozzle coupled to the fluid stream separating device, and discharging the cold discharge component of the fire extinguishing agent through another discharge nozzle coupled to the fluid stream separating device.

D4. The method of any one of paragraphs D1-D3, further comprising:

discharging the hot discharge component of the fire extinguishing agent that is above the boiling point as one of a vapor and a liquid into an air flow adjacent an engine for extinguishing a fire, and discharging the cold discharge component of the fire extinguishing agent that is below the boiling point as one of a vapor and a liquid onto a surface of the engine to be cooled.

D5. The method of any one of paragraphs D1-D4, wherein the fire extinguishing agent is stored in the fluid storage container as a cryogenic fluid.

D6. The method of any one of paragraphs D1-D5, further comprising discharging the fire extinguishing agent at a fire extinguishing agent discharge location with at least one integral discharge nozzle of a respective fluid stream separating device.

D7. The method of any one of paragraphs D1-D6, further comprising discharging the fire extinguishing agent at a fire extinguishing agent discharge location with at least one remote discharge nozzle coupled to a respective fluid stream separating device.

D8. The method of any one of paragraphs D1-D7, further comprising manually manipulating, with the one or more fluid stream separating devices, one or more predetermined characteristics of the fire extinguishing agent flowing through the one or more fluid stream separating devices.

D9. The method of any one of paragraphs D1-D8, further comprising automatically manipulating, with the one or more fluid stream separating devices, one or more predetermined characteristics of the fire extinguishing agent flowing through the one of the one or more fluid stream separating devices.

D10. The method of any one of paragraphs D1-D9, further comprising manipulating a temperature of the fire extinguishing agent flowing through the one or more fluid stream separating devices.

D11. The method of any one of paragraphs D1-D10, further comprising manipulating a mass flow of the fire extinguishing agent flowing through the one or more fluid stream separating devices.

D12. The method of any one of paragraphs D1-D11, further comprising manipulating liquid and vapor mass states of the fire extinguishing agent flowing through the one or more fluid stream separating devices.

E1. A method of using a fire extinguishing system, the method comprising:

storing a fire extinguishing agent in a fluid storage container; and raising, with one or more vortex tubes coupled to the fluid storage container, a temperature of at least a portion of the fire extinguishing agent flowing through the one or more vortex tubes above a boiling point of the fire extinguishing agent at ambient environmental conditions of a discharge location of the one or more vortex tubes.

E2. The method of paragraph E1, further comprising discharging the fire extinguishing agent with a respective vortex tube at a fire extinguishing agent discharge location with at least one integral discharge nozzle of the respective vortex tube.

E3. The method of any one of paragraphs E1-E2, further comprising discharging the fire extinguishing agent with a respective vortex tube at a fire extinguishing agent discharge location with at least one remote discharge nozzle coupled to the respective vortex tube.

E4. The method of any one of paragraphs E1-E3, further comprising:

discharging the portion of the fire extinguishing agent that is above the boiling point as one of a vapor and a liquid into an air flow for extinguishing a fire, and discharging another portion of the fire extinguishing agent that is below the boiling point as one of a vapor and a liquid onto a surface to be cooled.

E5. The method of any one of paragraphs E1-E4, wherein the fire extinguishing agent is stored in the fluid storage container as a cryogenic fluid.

E6. The method of any one of paragraphs E1-E5, further comprising manually manipulating, with the one or more vortex tubes, one or more predetermined characteristics of the fire extinguishing agent flowing through the one or more vortex tubes.

E7. The method of any one of paragraphs E1-E6, further comprising automatically manipulating, with the one or more vortex tubes, one or more predetermined characteristics of the fire extinguishing agent flowing through the one or more vortex tubes.

E8. The method of any one of paragraphs E1-E7, further comprising manipulating a temperature of the fire extinguishing agent flowing through the one or more vortex tubes.

E9. The method of any one of paragraphs E1-E8, further comprising manipulating a mass flow of the fire extinguishing agent flowing through the one or more vortex tubes.

E10. The method of any one of paragraphs E1-E9, further comprising manipulating liquid and vapor mass states of the fire extinguishing agent flowing through the one or more vortex tubes.

In the figures, referred to above, solid lines, if any, connecting various elements and/or components may represent mechanical, electrical, fluid, optical, electromagnetic, wireless and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the drawings may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in the figures, may be combined in various ways without the need to include other features described in the figures, other drawing figures, and/or the accompanying disclosure, even though such combination or combinations are not explicitly illustrated herein. Similarly, additional features not limited to the examples presented, may be combined with some or all of the features shown and described herein.

In FIGS. 7 and 8, referred to above, the blocks may represent operations and/or portions thereof and lines connecting the various blocks do not imply any particular order or dependency of the operations or portions thereof. Blocks represented by dashed lines, if any, indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 7 and 8 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or substantially simultaneously. Additionally, those skilled in the art will appreciate that not all operations described need be performed.

In the foregoing description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Different examples of the apparatus(es) and method(s) disclosed herein include a variety of components, features, and functionalities. It should be understood that the various examples of the apparatus(es), system(s), and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A fire extinguishing system comprising:

a fluid storage container configured to store a fire extinguishing agent; and a fluid stream separating device including a vortex tube coupled to the fluid storage container, where the fire extinguishing agent passes from the fluid storage container through the vortex tube so that the vortex tube raises a temperature of at least a portion of the fire extinguishing agent flowing through the vortex tube above a boiling point of the fire extinguishing agent at ambient environmental conditions of a discharge location of the fluid stream separating device;

wherein the fluid stream separating device is positioned to:

discharge the portion of the fire extinguishing agent that is above the boiling point as one of a vapor and a liquid into an engine compartment of a vehicle for extinguishing a fire, and discharge another portion of the fire extinguishing agent that is below the boiling point as one of a vapor and a liquid onto a surface of an engine, within the engine compartment, to be cooled.

2. The fire extinguishing system of claim 1, wherein the fluid stream separating device is disposed at a fire extinguishing agent discharge location and includes at least one integral discharge nozzle to discharge the fire extinguishing agent at the fire extinguishing agent discharge location.

3. The fire extinguishing system of claim 2, wherein the at least one integral discharge nozzle includes one or more of a vapor discharge and a liquid discharge.

4. The fire extinguishing system of claim 1, further comprising at least one discharge nozzle coupled to the fluid stream separating device, the at least one discharge nozzle being disposed at a fire extinguishing agent discharge location.

5. The fire extinguishing system of claim 1, wherein the fluid stream separating device is positioned to:

discharge the portion of the fire extinguishing agent that is above the boiling point as one of a vapor and a liquid into an air flow for extinguishing a fire, and discharge another portion of the fire extinguishing agent that is below the boiling point as one of a vapor and a liquid onto a surface to be cooled.

6. The fire extinguishing system of claim 1, wherein the vortex tube of the fluid stream separating device includes at least one fixed valve that defines a temperature difference between the portion of the fire extinguishing agent flowing through the vortex tube above the boiling point of the fire extinguishing agent and another portion of the fire extinguishing agent flowing through the vortex tube below the boiling point of the fire extinguishing agent.

7. The fire extinguishing system of claim 1, wherein the vortex tube of the fluid stream separating device includes at least one movable valve that varies an outlet size of the vortex tube to vary a temperature difference between the portion of the fire extinguishing agent flowing through the vortex tube above the boiling point of the fire extinguishing agent and another portion of the fire extinguishing agent flowing through the vortex tube below the boiling point of the fire extinguishing agent.

8. The fire extinguishing system of claim 1, wherein the vortex tube is configured to mechanically separate the fire extinguishing agent flowing through the fluid stream separating device into a vapor component and a liquid component, where the vapor component has a temperature above the boiling point of the fire extinguishing agent.

9. The fire extinguishing system of claim 1, wherein the fluid stream separating device is configured for manual manipulation of one or more predetermined characteristics of the fire extinguishing agent flowing through the fluid stream separating device.

10. The fire extinguishing system of claim 1, wherein the fluid stream separating device is configured for automatic manipulation of one or more predetermined characteristics of the fire extinguishing agent flowing through the fluid stream separating device.

11. A fire extinguishing system for a vehicle having an engine, the fire extinguishing system comprising:

a fluid storage container configured to store a fire extinguishing agent; and a fluid stream separating device coupled to the fluid storage container, the fluid stream separating device being configured to mechanically separate the fire extinguishing agent flowing through the fluid stream separating device into a hot discharge component and a cold discharge component, where the hot discharge component has a temperature above a boiling point of the fire extinguishing agent at ambient environmental conditions of a discharge location of the fluid stream separating device, wherein the fluid stream separating device is configured to increase the temperature of at least a portion of the hot discharge component to above the boiling point through a conservation of enthalpy as the fire extinguishing agent is being discharged from the fire extinguishing system;

wherein the fluid stream separating device is positioned to:

discharge the hot discharge component of the fire extinguishing agent that is above the boiling point as one of a vapor and a liquid into an air flow adjacent the engine for extinguishing a fire, and discharge the cold discharge component of the fire extinguishing agent that is below the boiling point as one of a vapor and a liquid onto a surface of the engine to be cooled.

12. The fire extinguishing system of claim 11, wherein the fluid stream separating device comprises a vortex tube.

13. The fire extinguishing system of claim 12, wherein the vortex tube of the fluid stream separating device includes at least one movable valve that varies an outlet size of the vortex tube to vary a temperature difference between the hot discharge component flowing through the vortex tube above the boiling point of the fire extinguishing agent and the cold discharge component flowing through the vortex tube below the boiling point of the fire extinguishing agent.

14. The fire extinguishing system of claim 11, wherein the fluid stream separating device is disposed adjacent the engine at a fire extinguishing agent discharge location, the fluid stream separating device includes at least one integral discharge nozzle to discharge the fire extinguishing agent at the fire extinguishing agent discharge location.

15. The fire extinguishing system of claim 11, further comprising at least one remote discharge nozzle coupled to the fluid stream separating device, each of the at least one remote discharge nozzle being disposed adjacent the engine at a fire extinguishing agent discharge location.

16. A method of using the fire extinguishing system of claim 11, the method comprising:

storing the fire extinguishing agent in the fluid storage container; and mechanically separating, with the fluid stream separating device coupled to the fluid storage container, the fire extinguishing agent flowing through the fluid stream separating device into the hot discharge component and the cold discharge component, where the hot discharge component has a temperature above the boiling point of the fire extinguishing agent at ambient environmental conditions of the discharge location of the fluid stream separating device, wherein the fluid stream separating device increases the temperature of at least the portion of the hot discharge component to above the boiling point through the conservation of enthalpy as the fire extinguishing agent is being discharged from the fire extinguishing system.

17. The method of claim 16, further comprising:

discharging the hot discharge component of the fire extinguishing agent that is above the boiling point as one of a vapor and a liquid into an air flow adjacent an engine for extinguishing a fire, and discharging the cold discharge component of the fire extinguishing agent that is below the boiling point as one of a vapor and a liquid onto a surface of the engine to be cooled.

18. The method of claim 16, further comprising manipulating a temperature of the fire extinguishing agent flowing through the one or more fluid stream separating devices.

19. The method of claim 16, further comprising manipulating a mass flow of the fire extinguishing agent flowing through the one or more fluid stream separating devices.

20. The method of claim 16, further comprising manipulating liquid and vapor mass states of the fire extinguishing agent flowing through the one or more fluid stream separating devices.

* * * * *